US006328402B1

(12) United States Patent
Hotomi

(10) Patent No.: US 6,328,402 B1
(45) Date of Patent: Dec. 11, 2001

(54) INK JET RECORDING APPARATUS THAT CAN REPRODUCE HALF TONE IMAGE WITHOUT DEGRADING PICTURE QUALITY

(75) Inventor: Hideo Hotomi, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/261,076

(22) Filed: Mar. 2, 1999

Related U.S. Application Data

(63) Continuation-in-part of application No. 09/006,405, filed on Jan. 13, 1998, now abandoned.

(30) Foreign Application Priority Data

Jan. 13, 1997 (JP) ..... 9-003965
Jan. 13, 1997 (JP) ..... 9-003966
Mar. 3, 1998 (JP) ..... 10-050359

(51) Int. Cl.[7] ..... B41J 2/205
(52) U.S. Cl. ..... 347/15
(58) Field of Search ..... 347/15, 20, 10, 347/60, 9, 11, 68

(56) References Cited

U.S. PATENT DOCUMENTS 5,124,716 * 6/1992 Roy et al. ..... 347/15
5,170,177 * 12/1992 Stanley et al. ..... 347/10
5,461,403 * 10/1995 Wallace et al. ..... 347/10

FOREIGN PATENT DOCUMENTS 6-40031 2/1994 (JP) ..... B41J/2/045
6-171080 6/1994 (JP) ..... B41J/2/045

* cited by examiner

*Primary Examiner*—John Barlow
*Assistant Examiner*—Juanita Stephens
(74) *Attorney, Agent, or Firm*—Sidley Austin Brown & Wood

(57) ABSTRACT

An ink jet printer includes a piezoelectric element, and a voltage generation device for applying a voltage to the piezoelectric element. The voltage generation device applies a pulse voltage having a rising edge, a constant amplitude holding portion, and a falling edge for driving a piezoelectric element, whereby ink dots of a plurality of diameters are printed out to reproduce a half tone image. The waveform of the pulse voltage has the voltage boosted more gentle as the pulse amplitude becomes greater. The sudden strain of a piezoelectric element is prevented. An ink droplet of a particularly great diameter can be sprayed out stably. The conventionally encountered satellite dot, dot split noise, and ink hit position offset are prevented.

41 Claims, 35 Drawing Sheets

FIG. 16

| ITEM \ WAVEFORM | WAVEFORM 1 | WAVEFORM 2 | WAVEFORM 3 | WAVEFORM 4 | WAVEFORM 5 | WAVEFORM 6 | WAVEFORM 7 | WAVEFORM 8 | WAVEFORM 9 | WAVEFORM 10 |
|---|---|---|---|---|---|---|---|---|---|---|
| SATELLITE | ○ | ○ | ○ | ○ | ○ | ○ | ○ | △ | ○ | × |
| DOT SPLIT | ○ | ○ | ○ | ○ | △ | ○ | ○ | ○ | △ | △ |
| INK HIT POSITION OFFSET | ○ | ○ | ○ | ○ | ○ | ○ | △ | ○ | △ | ※ × |

※WHEN PULSE AMPLITUDE IS PARTICULARLY GREAT

FIG.25

| ITEM \ WAVEFORM | WAVEFORM 201 | WAVEFORM 202 | WAVEFORM 203 | WAVEFORM 204 | WAVEFORM 205 | WAVEFORM 206 | WAVEFORM 207 | WAVEFORM 208 |
|---|---|---|---|---|---|---|---|---|
| SATELLITE | ○ | ○ | ○ | ○ | ○ | ○ | × | × |
| DOT SPLIT | ○ | ○ | ○ | ○ | ○ | ○ | × | △ |
| INK HIT POSITION OFFSET | ○ | ○ | △ | ○ | △ | ○ | × | × |

INK JET RECORDING APPARATUS THAT CAN REPRODUCE HALF TONE IMAGE WITHOUT DEGRADING PICTURE QUALITY

This application is a continuation-in-part of U.S. patent application Ser. No. 09/006,405, filed Jan. 13, 1998, now abandoned, which claimed priority to Japanese patent application Serial No. 9-003965, filed Jan. 13, 1997 and to Japanese patent application Ser. No. 9-003966, filed Jan. 13, 1997. The contents of these Japanese applications were incorporated by reference into U.S. patent application Ser. No. 09/006,405 and are incorporated into this application by reference. This application also claims priority to Japanese patent application Serial No. 10-050359, filed Mar. 3, 1998. The contents of the latter application are also incorporated into this application by reference.

BACKGROUND OF THE INVENTION

1. Field of the Invention

The present invention relates to ink jet recording apparatuses, and more particularly, to an ink jet recording apparatus that can drive a piezoelectric element by applying a pulse voltage of a plurality of waveforms.

2. Description of the Related Art

Piezoelectric elements are conventionally used in the recording head of an ink jet printer. In such a recording head, the strain of the piezoelectric element driven by the applied voltage causes pressure to be applied to the ink within a predetermined closed cavity (ink channel). The ink is sprayed out towards a recording sheet from a nozzle provided in the ink channel in the form of ink droplets.

Ink droplets of a plurality of different size can be ejected by altering the level of the pulse amplitude of the rectangular pulse voltage applied to the piezoelectric element. Each ink droplet of various different size corresponds to a print dot diameter on the recording sheet. The half tone can be represented by controlling the magnitude of the pulse amplitude.

In such a printout by a rectangular pulse voltage, particularly in a printout of ink droplets of a greater diameter, various undesirable phenomena such as satellite (an ink droplet corresponding to a certain print dot diameter is sprayed out accompanying generation of a small ink droplet), dot split (the tip of the ink droplet sprayed out is split into two), curve (the direction of the ink droplet to be sprayed out is deviated) and the like are encountered. These phenomena of satellite, dot split, and curve become the cause of satellite dots, dot split noise, and ink hit position offset to significantly degrade the picture quality of the reproduced image.

Furthermore, in printout by means of a rectangular pulse voltage, particularly when the printout frequency which is the frequency of the pulse voltage to be applied is increased, similar undesirable phenomena such as satellite, dot split, and curve occurs. Thus, the picture quality of the image is significantly degraded by these phenomena.

Generation of a wave in the ink within the ink channel after an ink droplet is sprayed out towards a recording sheet is considered to be one cause of these phenomena of satellite, dot split, and curve. Although this wave is attenuated over time, application of a pulse voltage corresponding to the next ink droplet with the wave still occurring in the ink within the ink channel will cause the above-described satellite, dot split and curve phenomena.

SUMMARY OF THE INVENTION

In view of the foregoing, an object of the present invention is to provide an ink jet recording apparatus that can represent half tone without reducing image quality.

Another object of the present invention is to provide an ink jet recording apparatus that can have the frequency for applying a pulse voltage increased.

A further object is to provide an ink jet recording apparatus that can improve image quality while offering a large dynamic range.

According to an aspect of the present invention, an ink jet recording apparatus includes a piezoelectric element to which a voltage is applied for generating a strain to spray out an ink droplet, a voltage generation device for applying a voltage to the piezoelectric element according to predetermined data, said voltage generation device generating a voltage of a waveform having a rising edge, a constant amplitude duration, and a controller for providing control so that the increase of voltage with respect to the time at the rising edge becomes smaller in proportion to a greater voltage at the amplitude duration.

According to another aspect of the present invention, an ink jet recording apparatus includes a piezoelectric element to which a voltage is applied for generating a strain to spray out an ink droplet, a voltage generation device for applying a voltage to the piezoelectric element according to predetermined data, said voltage generation device generating a voltage of a waveform having a rising edge, an amplitude duration, and a falling edge, and a controller for setting a voltage y at the end of the rise of the waveform of the voltage at time x so as to be on the curve of $y=ax^n$ where a is a constant and n is a positive constant smaller than 1, or the curve of $x=a(0-\sin\theta)$, $y=b(1-\cos\theta)$ where a and b are constants and $\theta$ is a parameter.

According to a further aspect of the present invention, an ink jet recording apparatus includes a piezoelectric element to which a voltage is applied for generating a strain to spray out an ink droplet, a voltage generation device for applying a voltage to the piezoelectric element according to predetermined data, said voltage generation device generating a voltage of a waveform having a rising edge and a falling edge, and a controller for setting the time required for a fall to be longer than the time required for a rise.

According to still another aspect of the present invention, an ink jet recording apparatus includes an electromechanical conversion element to eject ink in an ink channel from a nozzle, a pulse apply unit to apply a pulse signal to the electromechanical conversion element, and a controller to control the pulse apply unit so that at least one of a rising speed and a falling speed of the pulse becomes lower as the amplitude of the pulse signal becomes greater.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 16 shows the evaluation of printout by ink droplets ejected from a piezoelectric element to which a pulse voltage of waveforms of the present invention is applied.

FIG. 25 shows evaluation of printout by ink droplets ejected from a piezoelectric element to which a pulse voltage according to embodiments 10–15 is applied.

DESCRIPTION OF THE PREFERRED EMBODIMENTS

An ink jet printer according to embodiments of the present invention will be described hereinafter with reference to the drawings.

(I) First Embodiment (1) Overall structure

Figure 1:
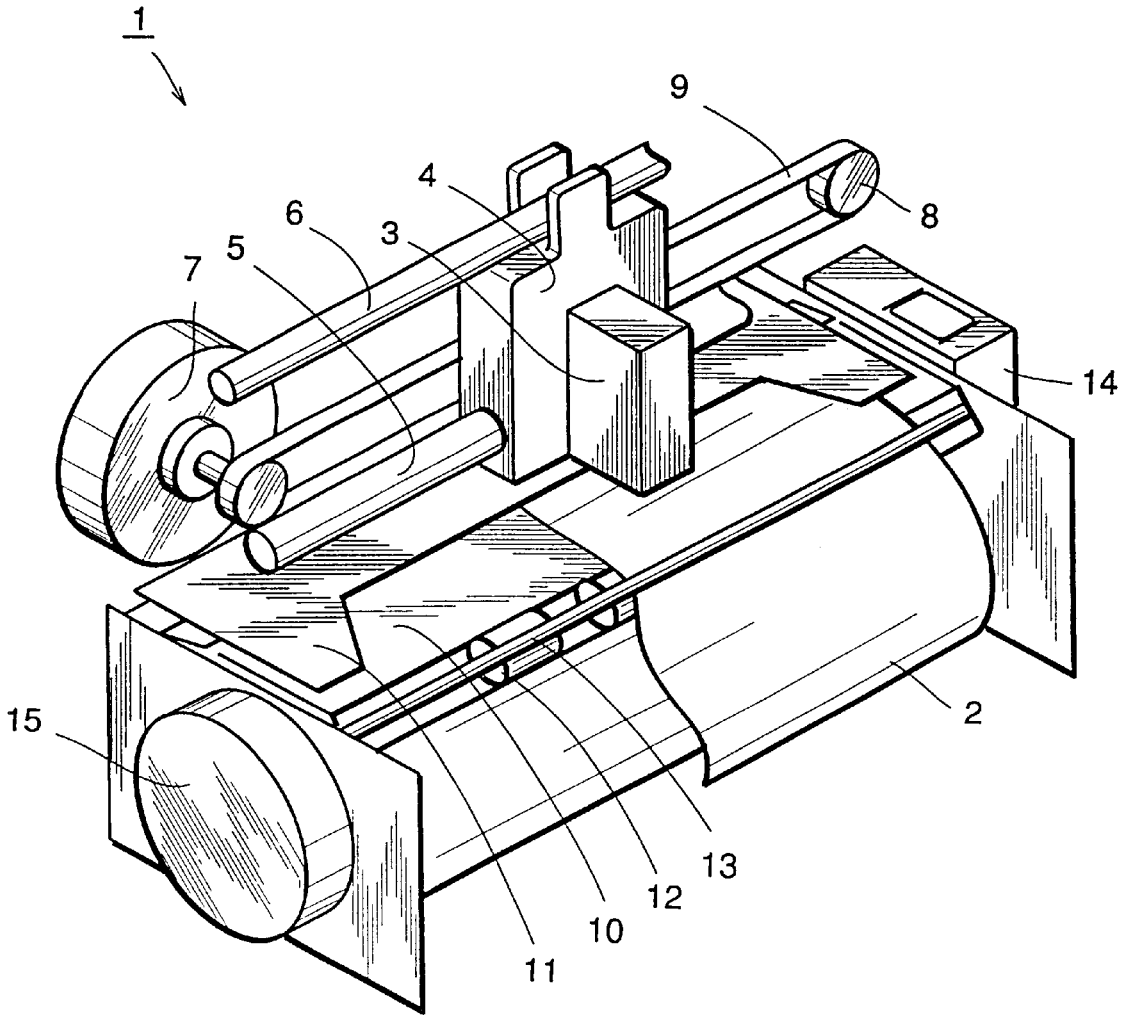
FIG. 1 is a perspective view showing a schematic structure of an ink jet printer according to a first embodiment of the present invention.

Referring to FIG. 1, an ink jet printer 1 includes a printer head 3 which is an ink jet type printer head for printing out an image on a recording sheet 2 which is a recording medium such as a paper sheet or an OHP sheet, a carriage 4 for holding printer head 3, slide shafts 5 and 6 on which carriage 4 is moved in a reciprocating manner parallel to the recording face of recording sheet 2, a drive motor 7 for driving carriage 4 back and forth along slide shafts 5 and 6, a timing belt 9 for converting the rotation of drive motor 7 into a reciprocating motion of carriage 4, and an idle pulley 8.

Ink jet printer 1 includes a platen 10 also serving as a guide panel for guiding recording sheet 2 through the transportation path, a sheet press plate 11 for preventing floating undulation of recording sheet 2 from plate 10, a discharge roller 12 for discharging recording sheet 2, a spur roller 13, a recovery system 14 for cleaning the nozzle face of printer head 3 from which ink is ejected to restore ink eject error to a favorable state, and a sheet feed knob 15 for conveying recording sheet 2 manually.

Recording sheet 2 is fed manually or by means of a sheet feed device such as a cut sheet feeder into a recording unit where printer head 3 and platen 10 face each other. The rotation of sheet feed roller not shown is controlled to control the transportation into the recording unit.

In printer head 3, a piezoelectric element (PZT) is employed as an energy generation source for spraying out ink. A voltage is applied to the piezoelectric element to generate a strain. This strain alters the volume of the channel filled with ink. This change in volume causes ink to be ejected from a nozzle provided in the channel to record on recording sheet 2.

Carriage 4 effects main scanning in the lateral direction of recording sheet 2 (the direction transversing recording sheet 2) by drive motor 7, idle pulley 8, and timing belt 9. Printer head 3 attached to carriage 4 records an image of one line. Recording sheet 2 is forwarded in the vertical direction for subscanning every time one line is recorded. Then, the next line is recorded.

Recording sheet 2 having an image recorded as described above and passing through the recording unit is then discharged by discharge roller 12 provided downstream of the transportation direction and spur roller 13 that is attached with pressure thereto.

Figure 2:
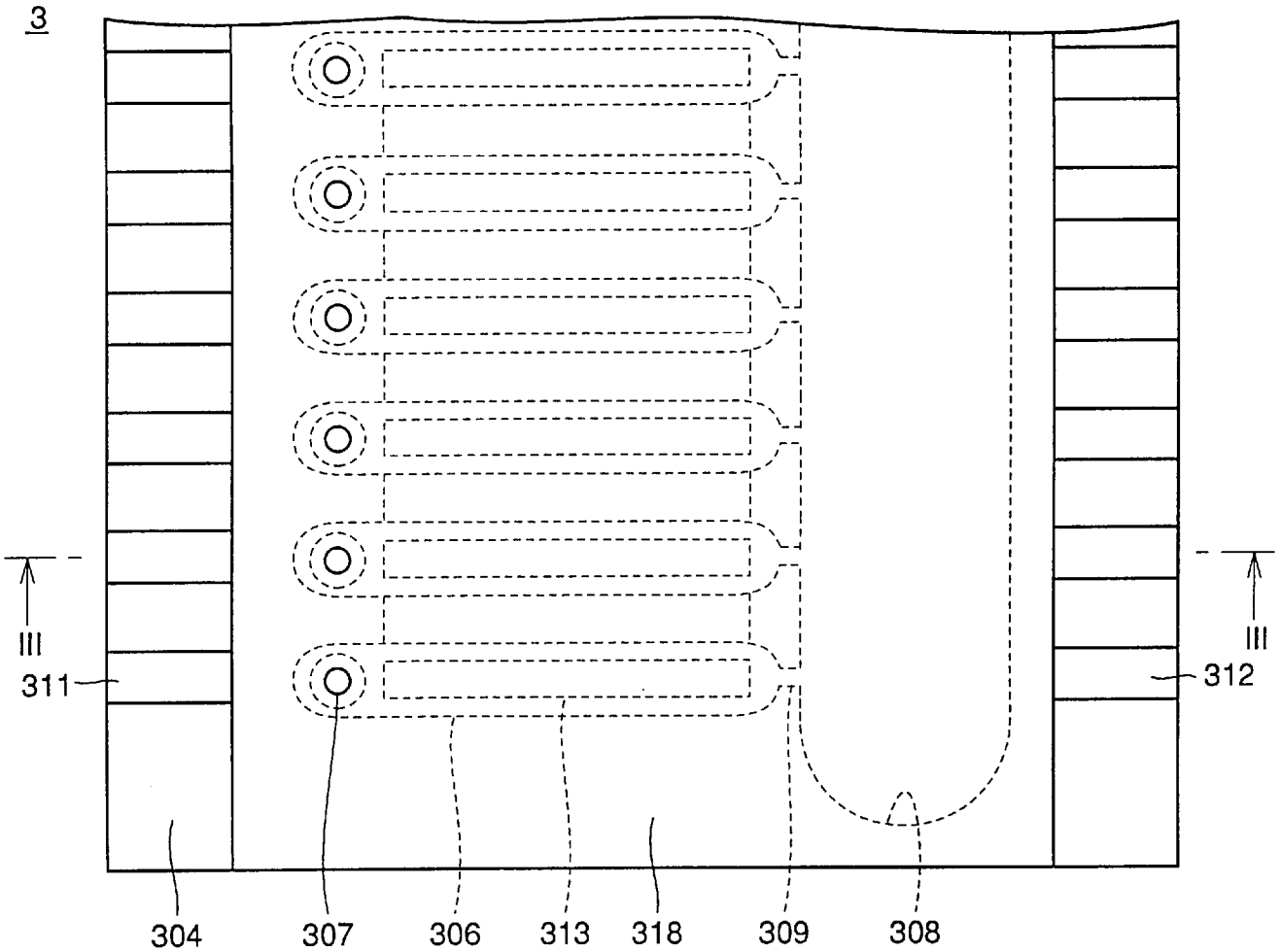
FIG. 2 is a plan view of the face including the nozzle of a printer head for describing the structure of the printer head.
Figure 3:
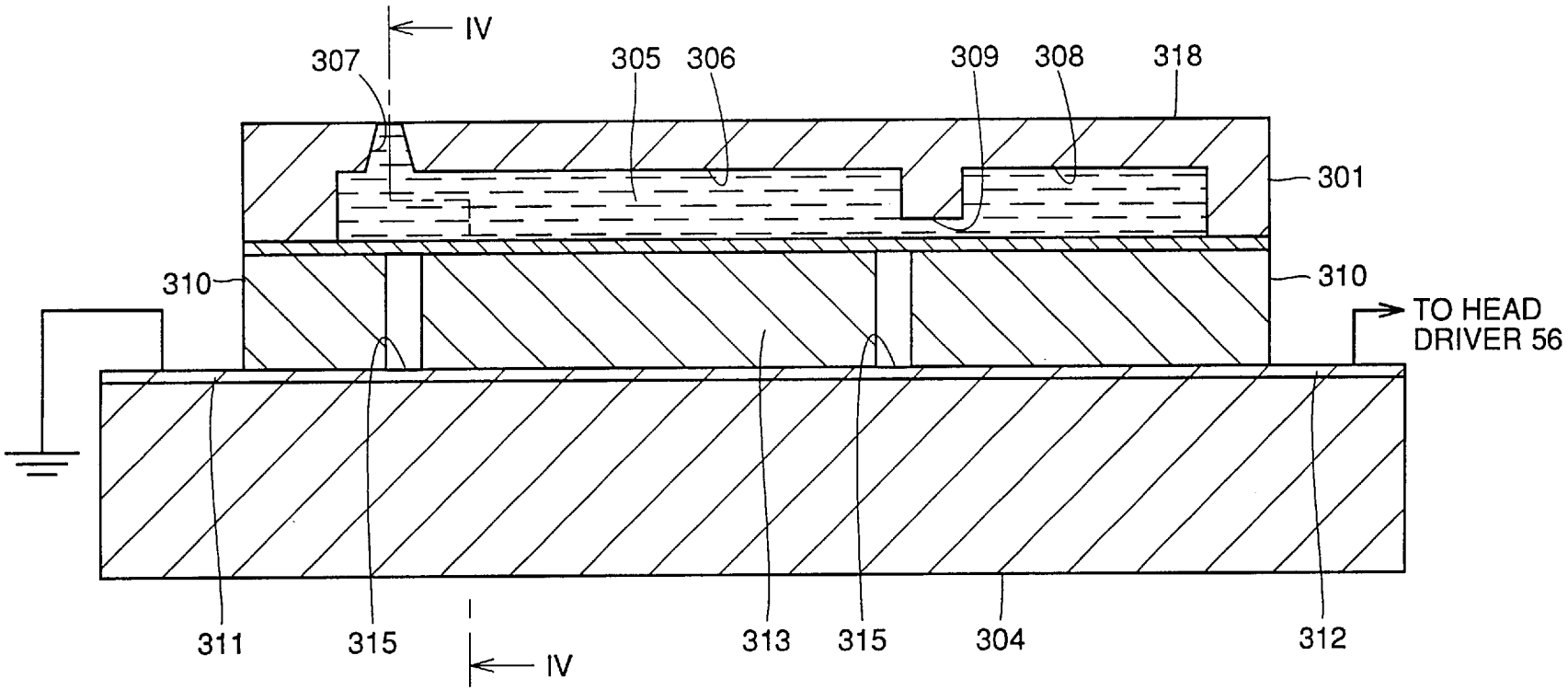
FIGS. 3 and 4 are sectional views taken along line III—III of FIG. 2 and line IV—IV of FIG. 3, respectively, for describing the structure of the printer head.
Figure 4:
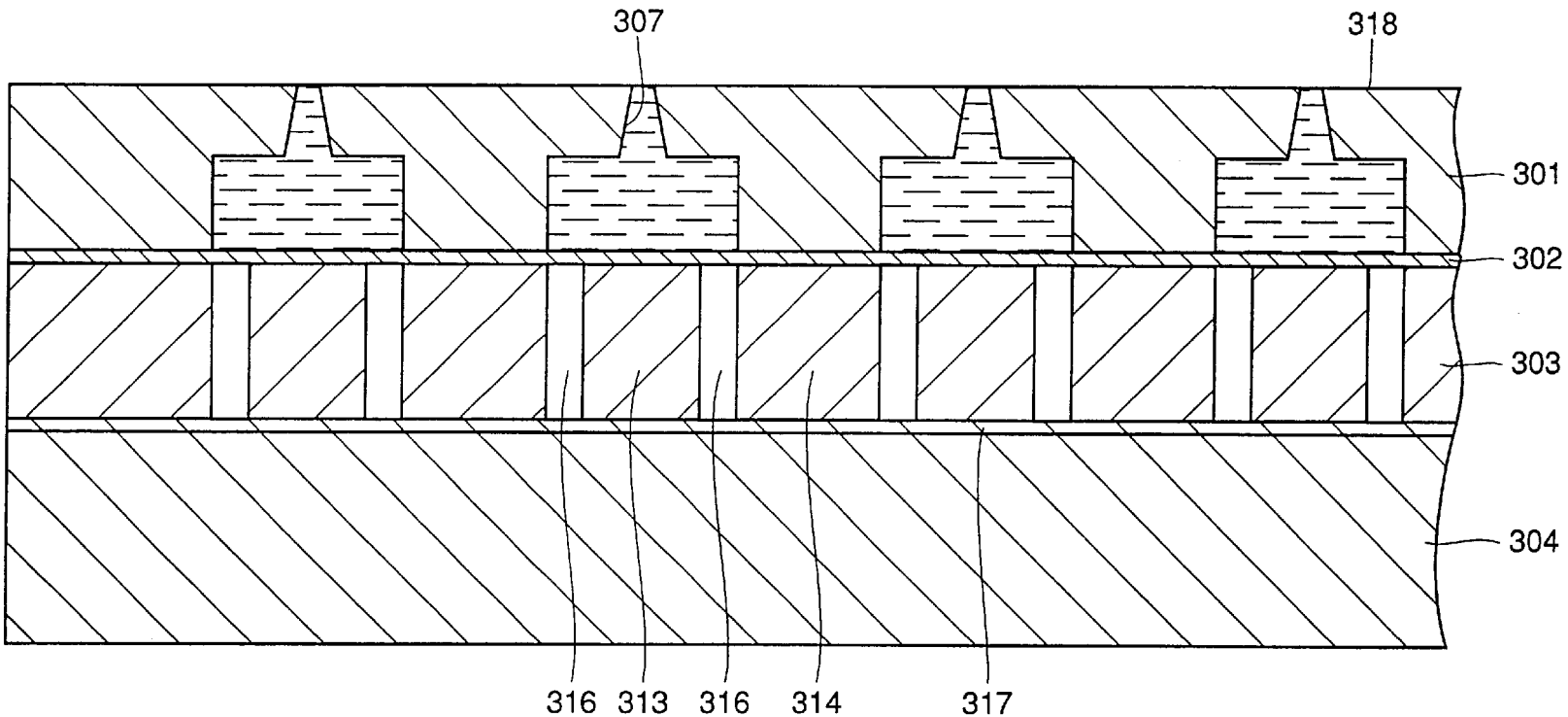

Referring to FIGS. 2–4, printer head 3 has a structure in which a nozzle plate 301, a partition wall 302, a diaphragm 303, and a substrate 304 are overlaid integrally.

Nozzle plate 303 is formed of metal or synthetic resin and has a nozzle 307. The surface 318 of nozzle plate 303 includes an ion repellent layer. Partition wall 302 is formed of a thin film, and is fixed between nozzle plate 301 and diaphragm 303.

A plurality of ink channels 306 for accommodating ink 305 and an ink inlet 309 for connecting each ink channel 306 to an ink supply chamber 308 are formed between nozzle plate 301 and partition wall 302. Ink supply chamber 308 is connected to an ink tank not shown. The ink 305 in ink chamber 308 is supplied to ink channel 306.

A plurality of piezoelectric elements 313 corresponding to each ink channel 306 are included in diaphragm 303. Diaphragm 303 is provided as set forth in the following. First, diaphragm 303 is fastened with an insulating adhesive to substrate 304 including an interconnection 317. Then, separate grooves 315 and 316 are formed by dicer working, whereby diaphragm 303 is divided. By this division, isolation is provided among piezoelectric element 313 corresponding to each ink channel 308, a piezoelectric element column 314 located between adjacent piezoelectric elements 313, and a wall 310 enclosing the same.

Interconnection 317 on substrate 304 includes a common electrode interconnection 311 connected to ground and in common to all piezoelectric elements 313 within printer head 3, and an individual electrode interconnection 312 connected individually to each piezoelectric element 313 within printer head 3. Common electrode interconnection 311 on substrate 304 is connected to the common electrode in piezoelectric element 313. Individual electrode interconnection 312 is connected to an individual electrode in piezoelectric element 313.

The operation of printer head 3 of the above-described structure is controlled by the controller of ink jet printer 1. A head driver 56 (refer to FIG. 5) of the controller applies a predetermined voltage which is a printout signal across the common electrode and the individual electrode provided in piezoelectric element 313. Piezoelectric element 313 is deformed in a direction pressing partition wall 302. Deformation of piezoelectric element 313 is conveyed to partition wall 302, whereby pressure is applied to ink 305 within ink channel 306. As a result, an ink droplet is sprayed out towards recording sheet 2 (refer to FIG. 1) through nozzle 307.

Figure 5:
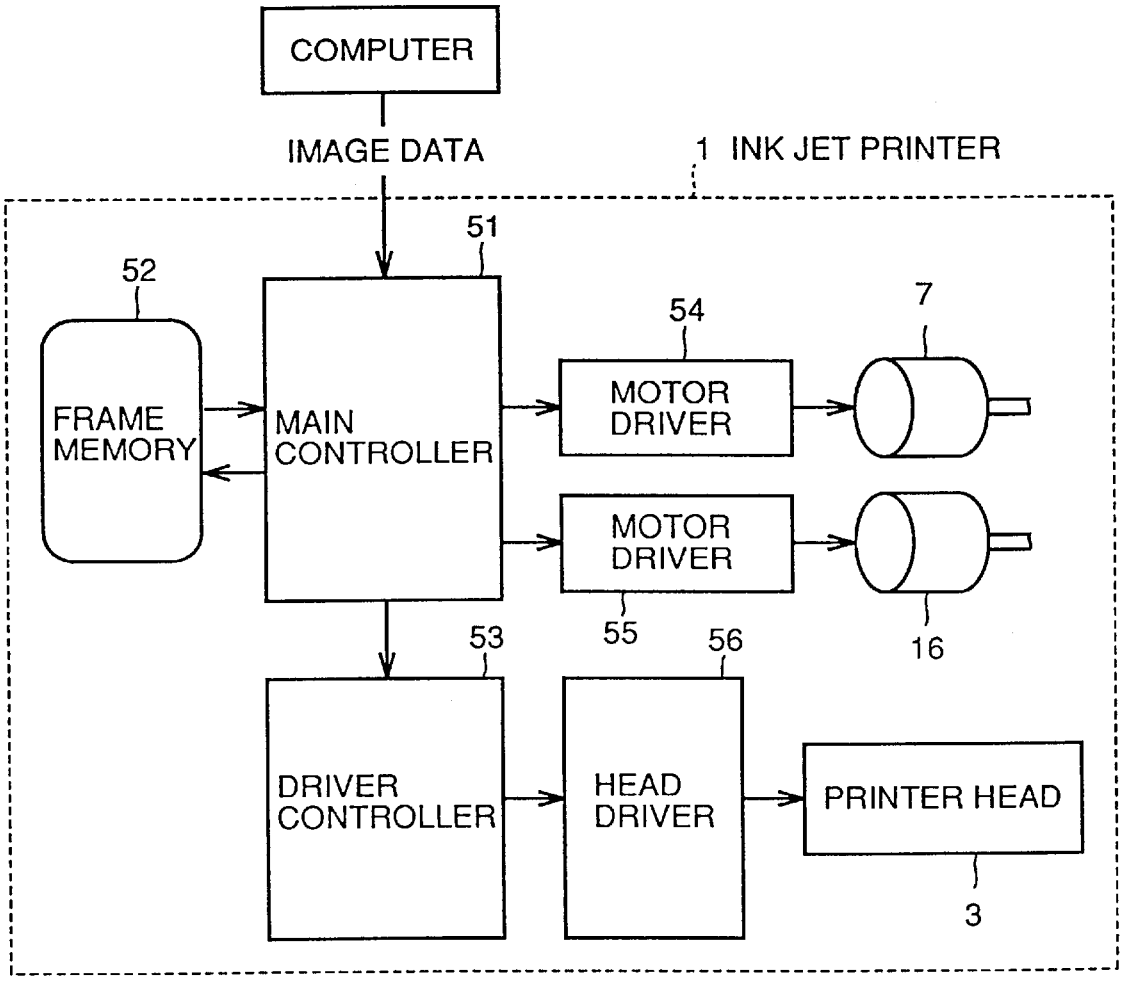
FIG. 5 is a block diagram showing a schematic structure of a control unit of an ink jet printer.

FIG. 5 is a block diagram showing the schematic structure of the controller of ink jet printer 1. Head driver 56 generates a pulse voltage that will be described afterwards. The generated pulse voltage is applied to piezoelectric element 313.

A main controller 51 receives image data from a computer and the like. The received image data is stored in a frame memory 52 for buffer in the unit of 1 frame. In a printout operation onto recording sheet 2, main controller 51 provides control of drive motor 7 and sheet feed motor 16 of carriage 4 through motor drivers 54 and 55.

Under the control, main controller 51 provides control of each piezoelectric element 313 within printer head 3 via driver controller 53 and head driver 56 according to the image data read out from frame memory 52.

The pulse voltage to piezoelectric element 313 shown in FIGS. 6–13 is applied by head driver 56.

FIGS. 6–13 show a set of waveforms 1–9 of a pulse voltage applied to a piezoelectric element within a printer head in an ink jet printer according to an embodiment of the present invention. These waveforms 1–9 correspond to ink jet printers of first to ninth embodiments, respectively. The entire structure of the ink jet printer, the structure of the printer head, the structure of the control unit and the like of the second to ninth embodiments are similar to those of the first embodiment.

Each set of waveform is represented with the voltage plotted along the ordinate and time plotted along the abscissa, all having the voltage application start time set equal to each other. Each waveform is identified by the character of a, b, c, . . . assigned in order from the smallest pulse amplitude. A point P1a (x1a, y1a), for example, in waveform 1*a* corresponds to a point on the coordinate indicating an applied voltage of y1a at the rising end time of x1a.

One set of waveform of a pulse voltage corresponds to a printout of a dot having a diameter size proportional to the amplitude. Dots of different size are printed out by applying a pulse voltage of different level to a piezoelectric element to represent the half tone.

A waveform of a pulse voltage includes a rising edge portion, an amplitude maintaining portion, and a falling edge portion. In the present example, all portions show a transition in a substantially linear manner. Control is provided so that the point representing an applied voltage at the time point of the end of a rise attains a predetermined relationship.

The predetermined relationship shown in each embodiment is set so that the increase of voltage with respect to the rise time becomes smaller for the applied voltage at the end of the rise. More specifically, the relationship is set so that the inclination of the rising edge becomes more gentle as the voltage is higher.

(A) When the pulse voltage is found along a predetermined curve

Figure 6:
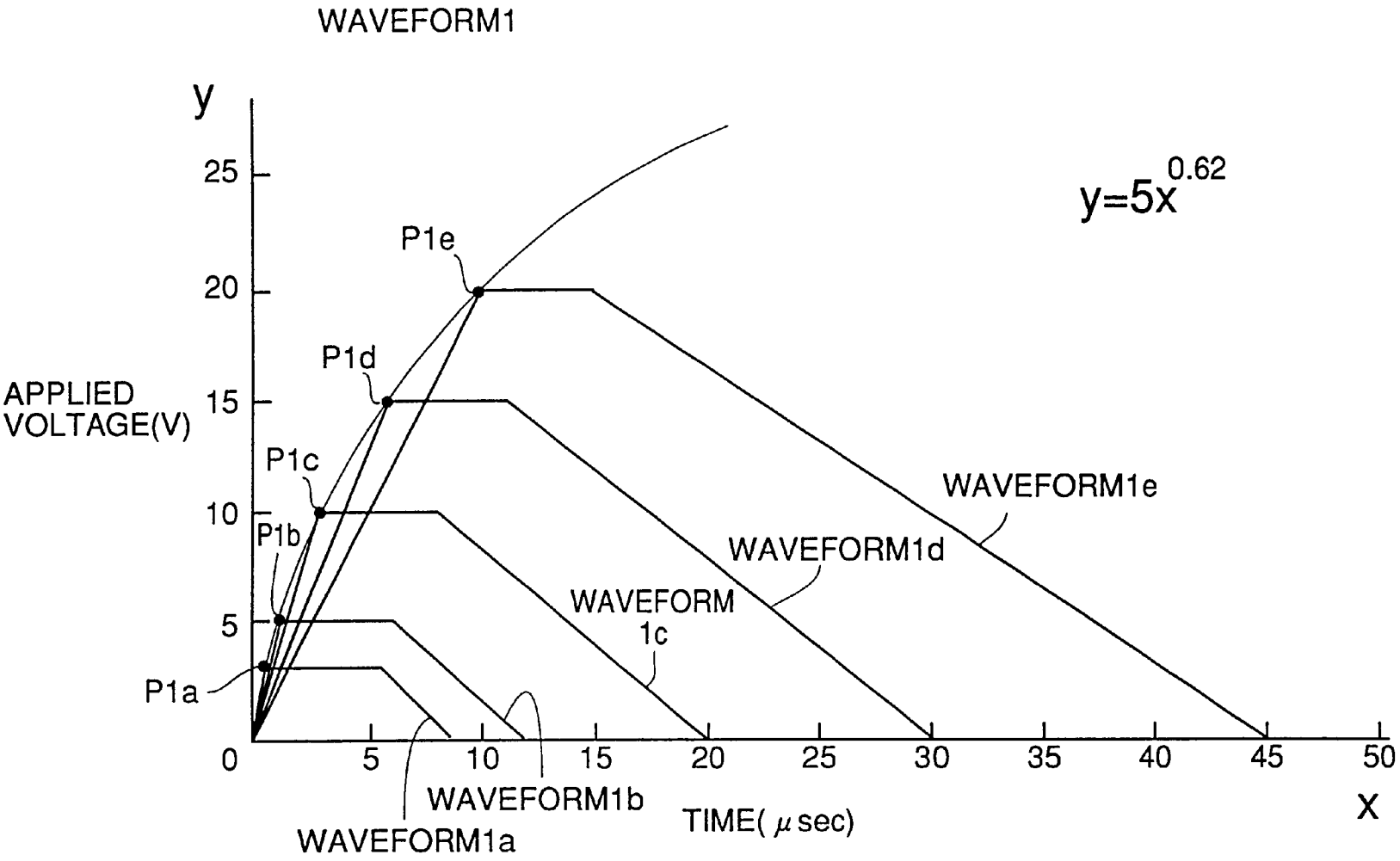
FIGS. 6–14 show waveforms of pulse voltages according to first to ninth embodiments, respectively, of the present invention.

FIG. 6 shows waveforms 1*a*–1*e* of a pulse voltage. In these waveforms 1*a*–1*e*, each rising end point P1a (x1a, y1a)~P1e (x1e, y1e) is located on $y=5x^{0.62}$.

Figure 7:
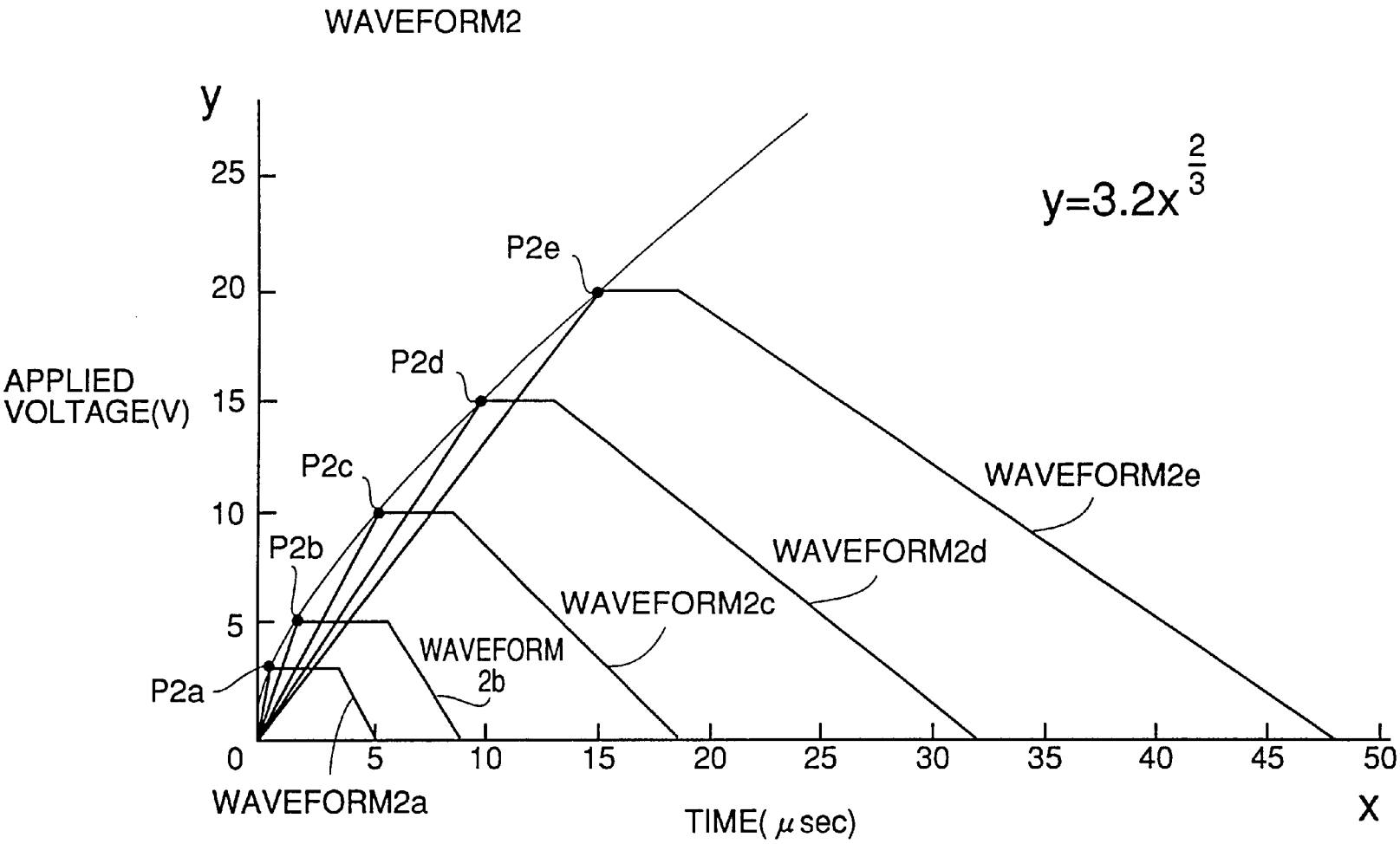

FIG. 7 shows waveforms 2*a*–2*e* of a pulse voltage. In these waveforms 2*a*–2*e*, each rising end point P2a (x2a, y2a)~P2e (x2e, y2e) is located on $y=3.2x^{2/3}$.

Figure 8:
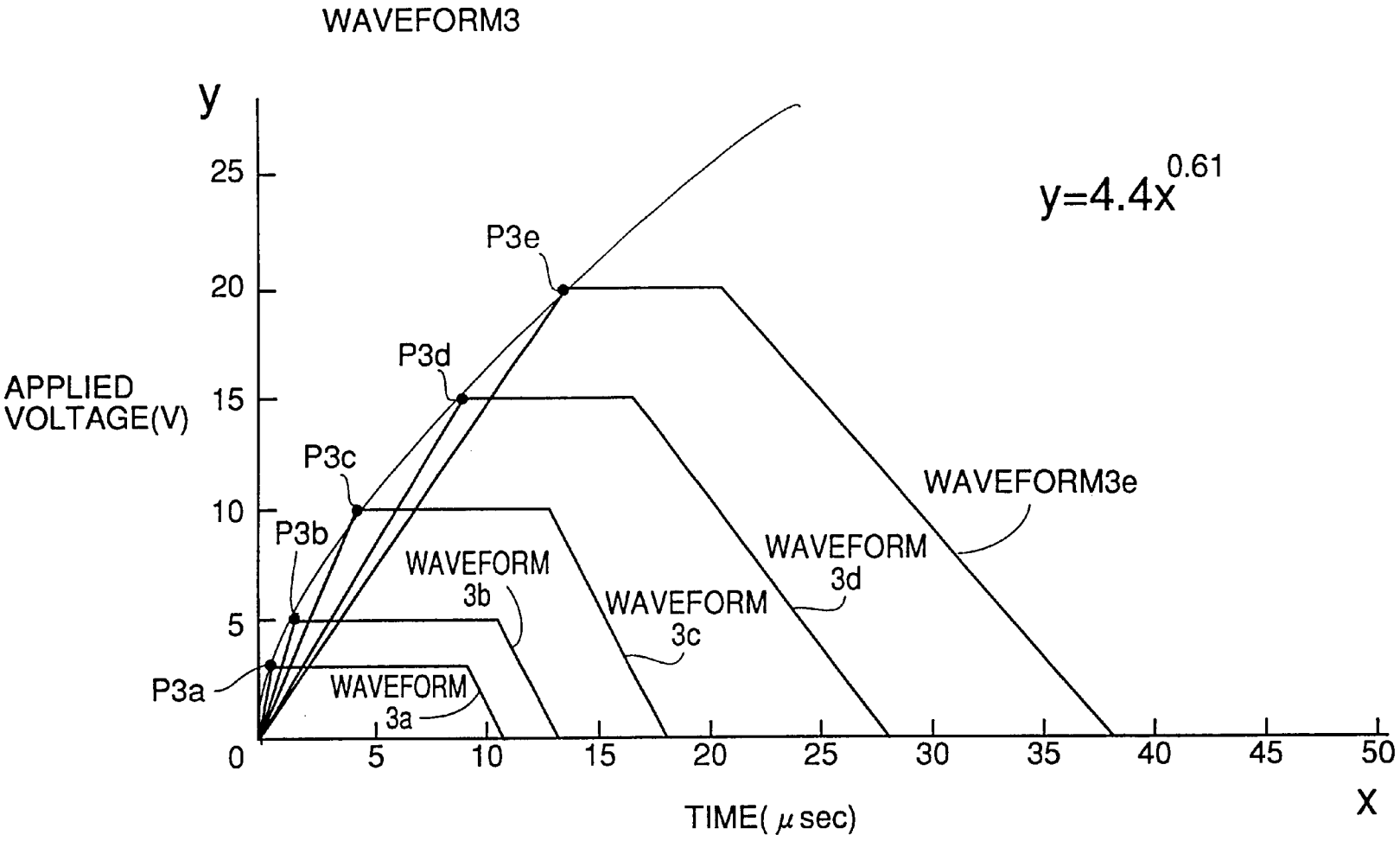

FIG. 8 shows waveforms 3*a*–3*e* of a pulse voltage. In these waveforms 3*a*–3*e*, each rising end point P3a (x3a, y3a)~P3e (x3e, y3e) is located on $y=4.4x^{0.61}$.

Figure 9:
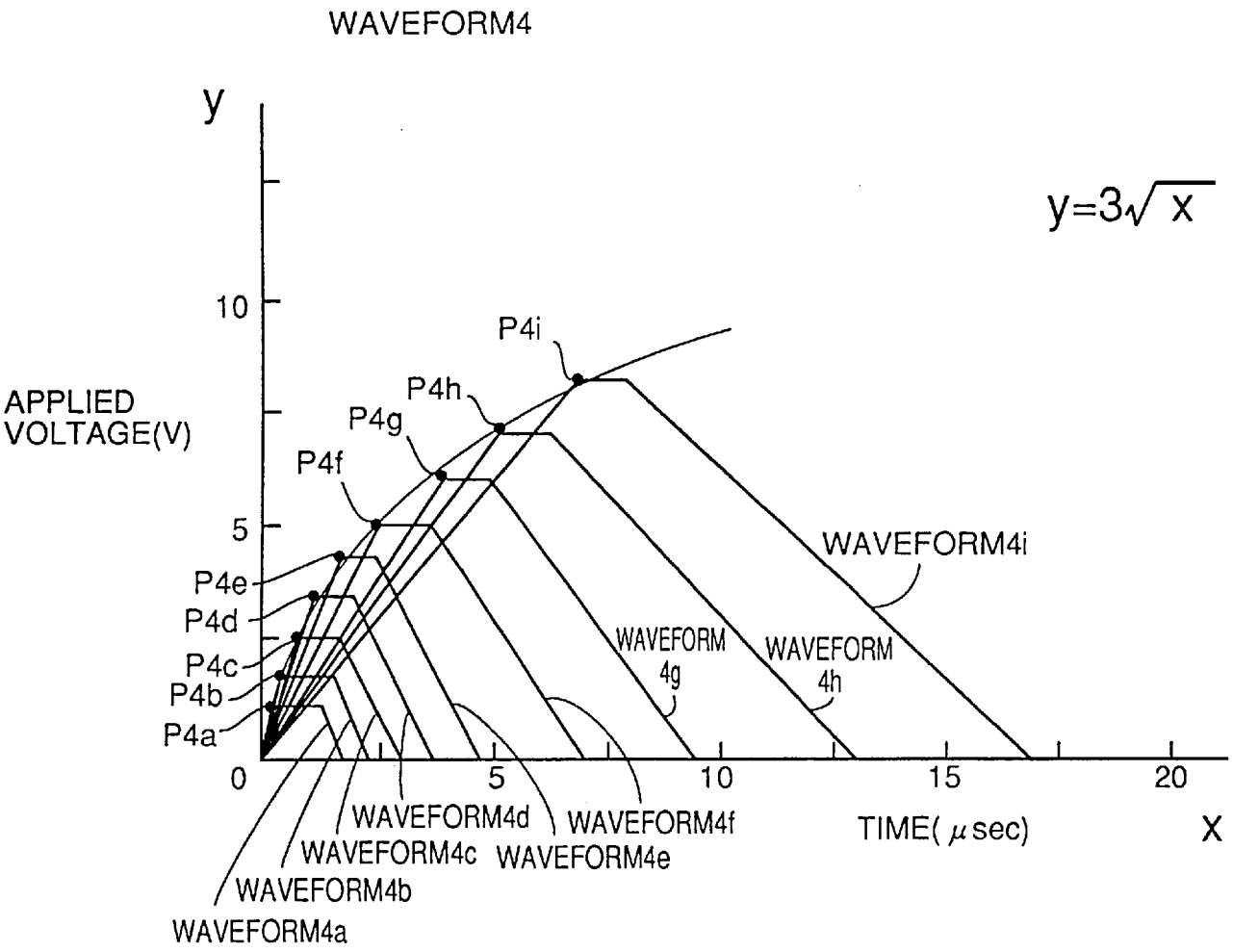

FIG. 9 shows waveforms 4*a*–4*i* of a pulse voltage. In these waveforms 4*a*–4*i*, each rising end point P4a (x4a, y4a)~P4i (x4i, y4i) is located on $y=3x^{1/2}$.

Figure 10:
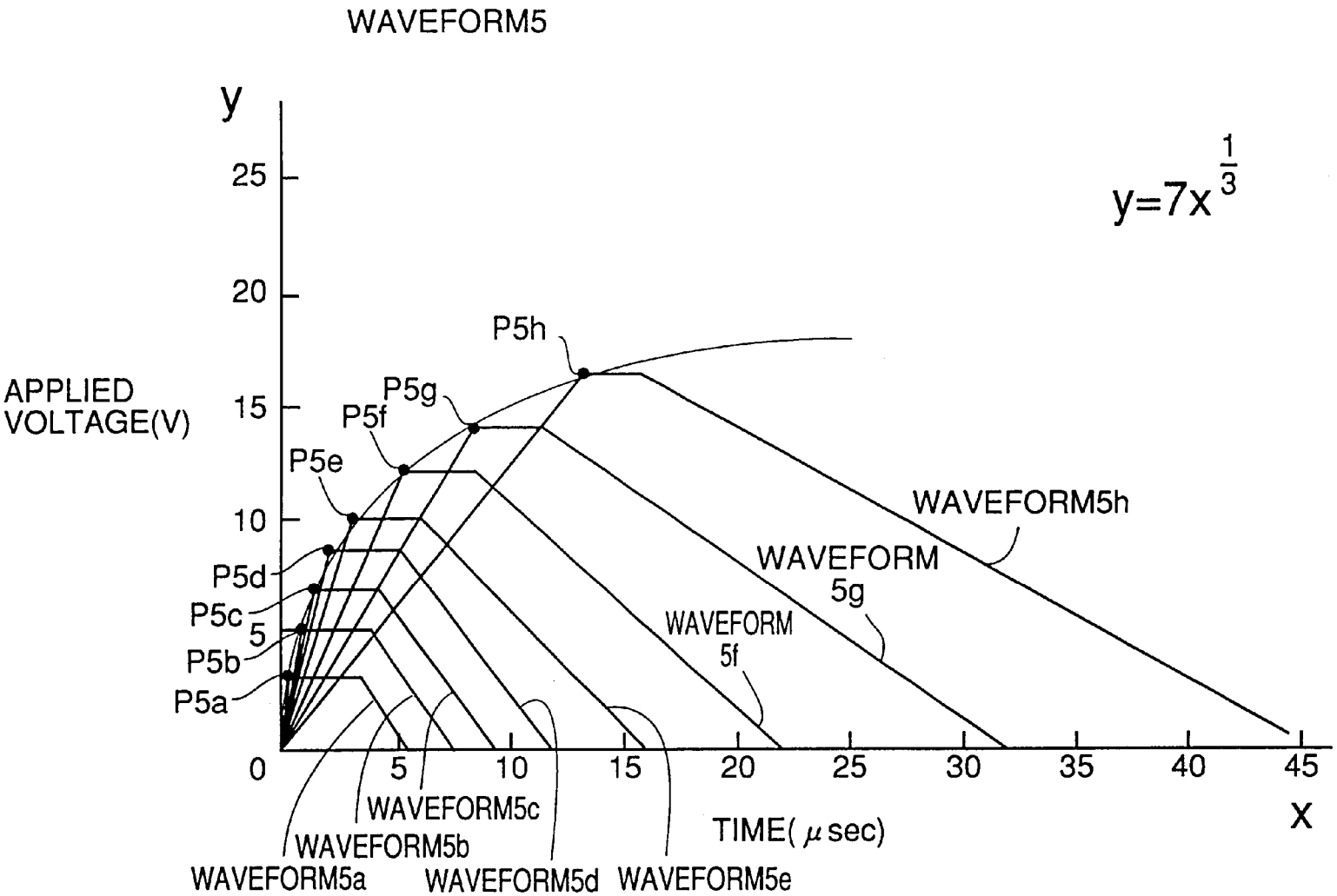

FIG. 10 shows waveforms 5*a*–5*h* of a pulse voltage. In these waveforms 5*a*–5*h*, each rising end point P5a (x5a, y5a)~P5h (x5h, y5h) is located on $y=7x^{1/3}$.

Figure 11:
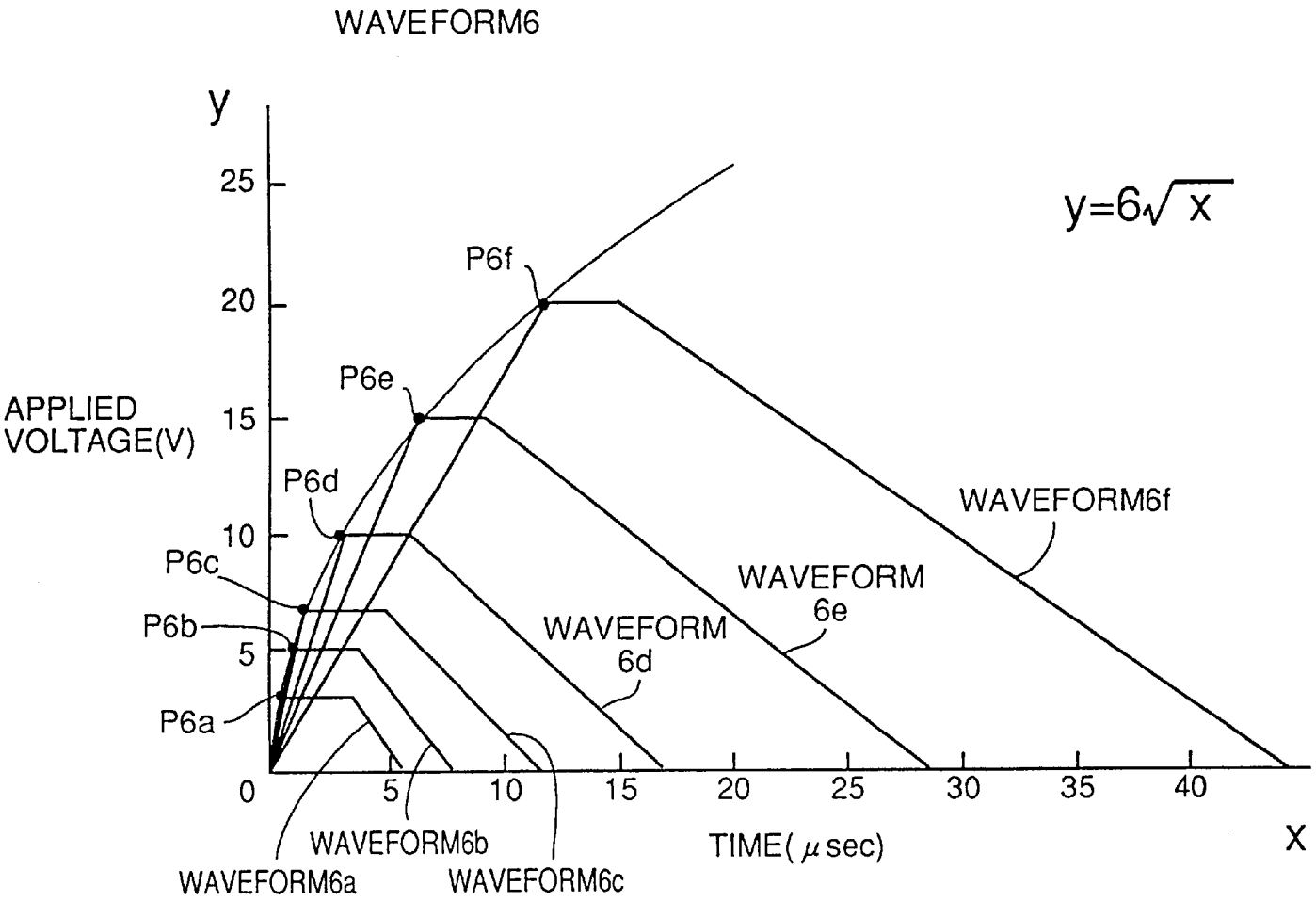

FIG. 11 shows waveforms 6*a*–6*f* of a pulse voltage. In these waveforms 6*a*–6*f*, each rising end point P6a (x6a, y6a)~P6f (x6f, y6f) is located on $y=6x^{1/2}$.

According to the waveforms shown in FIGS. 6–9, the inclination of the rising edge becomes more gentle as the voltage becomes higher. In the waveform shown in FIG. 10, the inclination of the rising edge is the same irrelevant to the level of the voltage. The waveform shown in FIG. 11 has a first inclination when at a small voltage and a second inclination when at a greater voltage.

Figure 12:
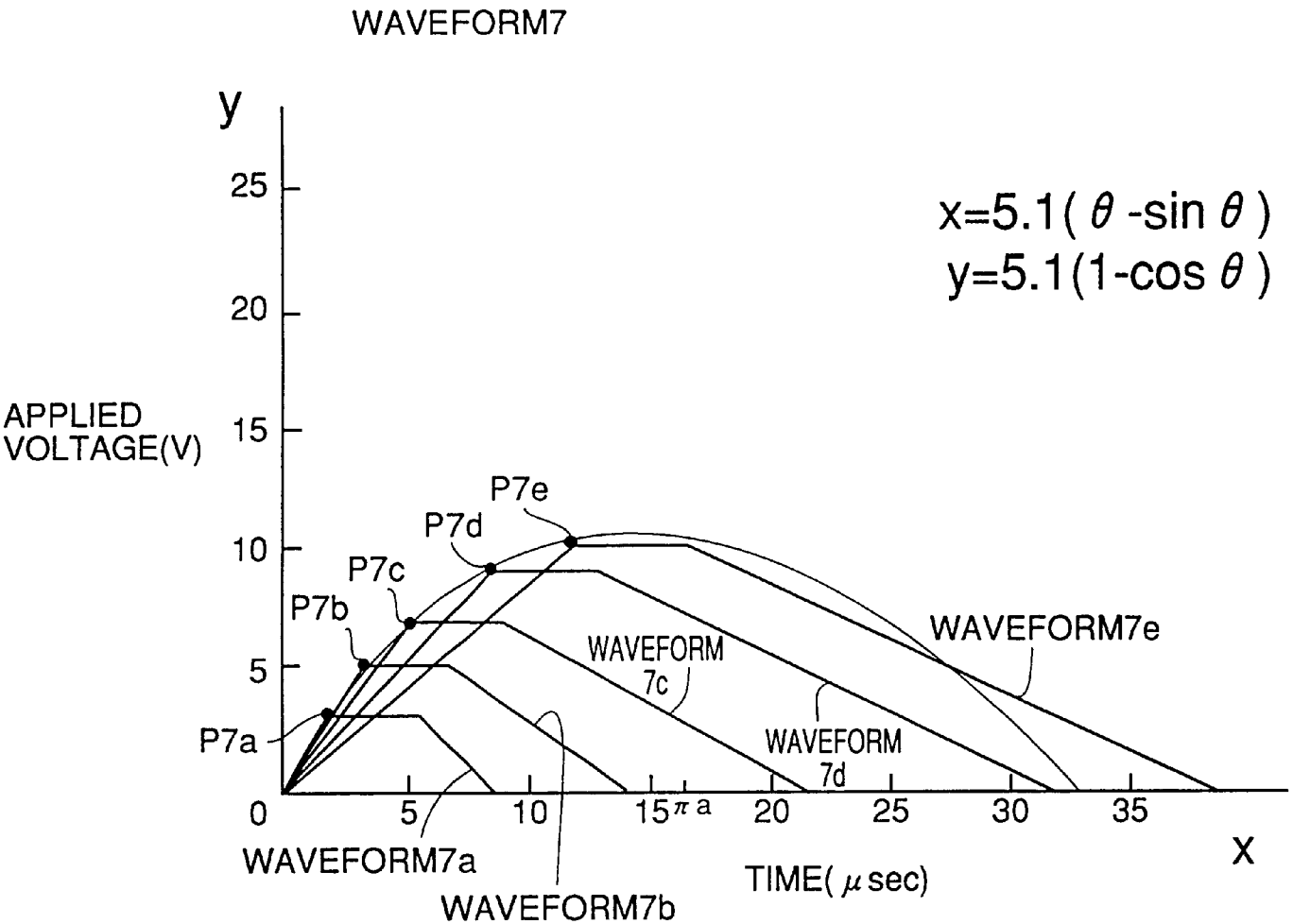

FIG. 12 shows waveforms 7*a*–7*e* of a pulse voltage. In these waveforms 7*a*–7*e*, each rising end point P7a (x7a, y7a)~P7e (x7e, y7e) is on $x=5.1(\theta-\sin\theta)$, $y=5.1(1-\cos\theta)$ ($\theta$ is a parameter).

Figure 13:
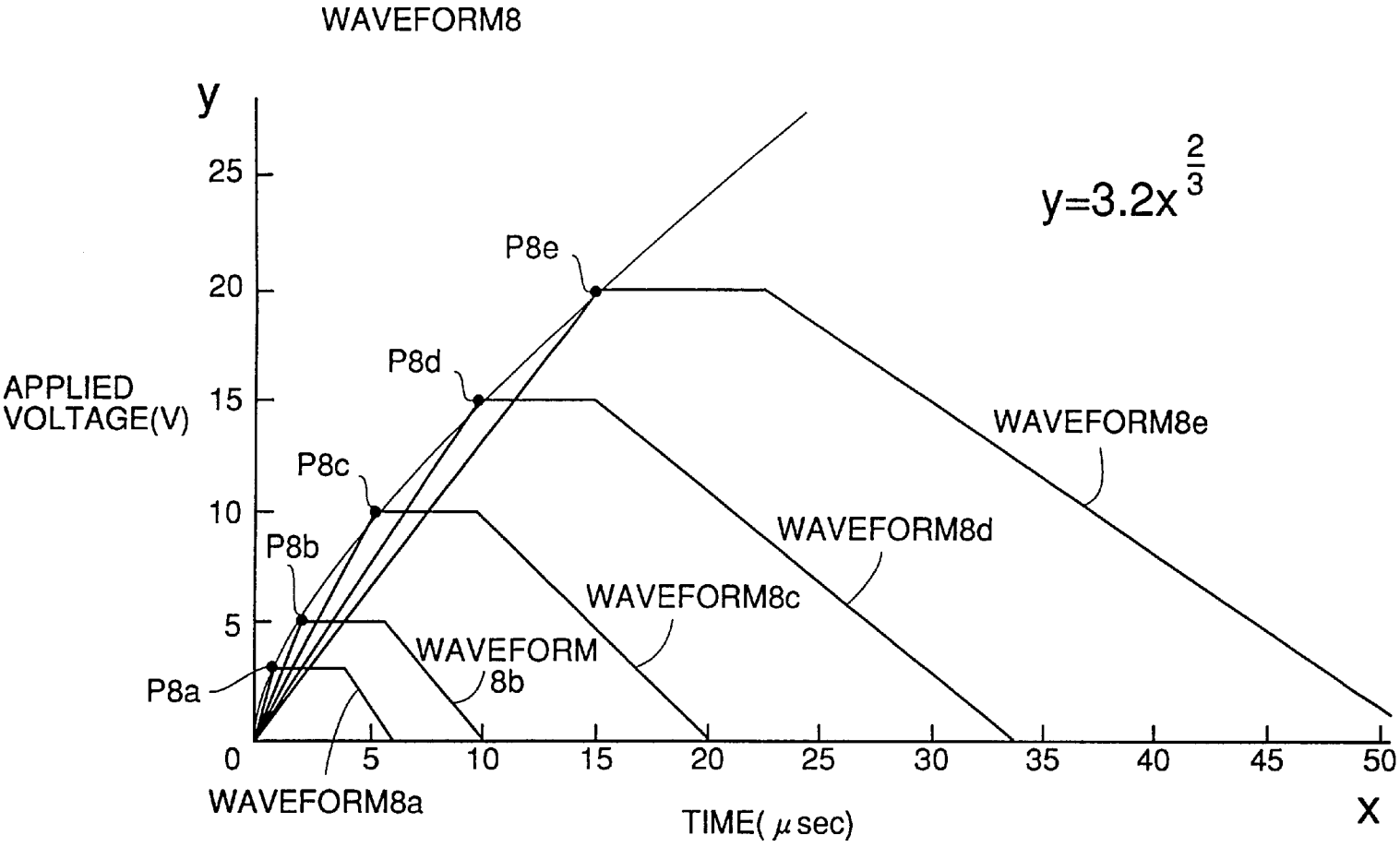

FIG. 13 shows waveforms 8*a*–8*e* of a pulse voltage. In these waveforms 8*a*–8*e*, each rising end point P8a (x8a, y8a)~P8e (x8e, y8e) is on $y=3.2x^{2/3}$.

It is appreciated from FIGS. 6–13 that, in waveforms 1–7, the duration of a certain pulse amplitude from the end of a rise to the start of a fall is equal, and the period of time thereof is 5, 3, 8, 1, 3, 3, 4 [$\mu$sec] in order. In waveform 8, the duration of the pulse amplitude differs depending upon each of waveforms 8*a*–8*e*, and the period of time thereof is 3, 4, 5, 6, 7 [$\mu$sec] in order.

Figure 14:
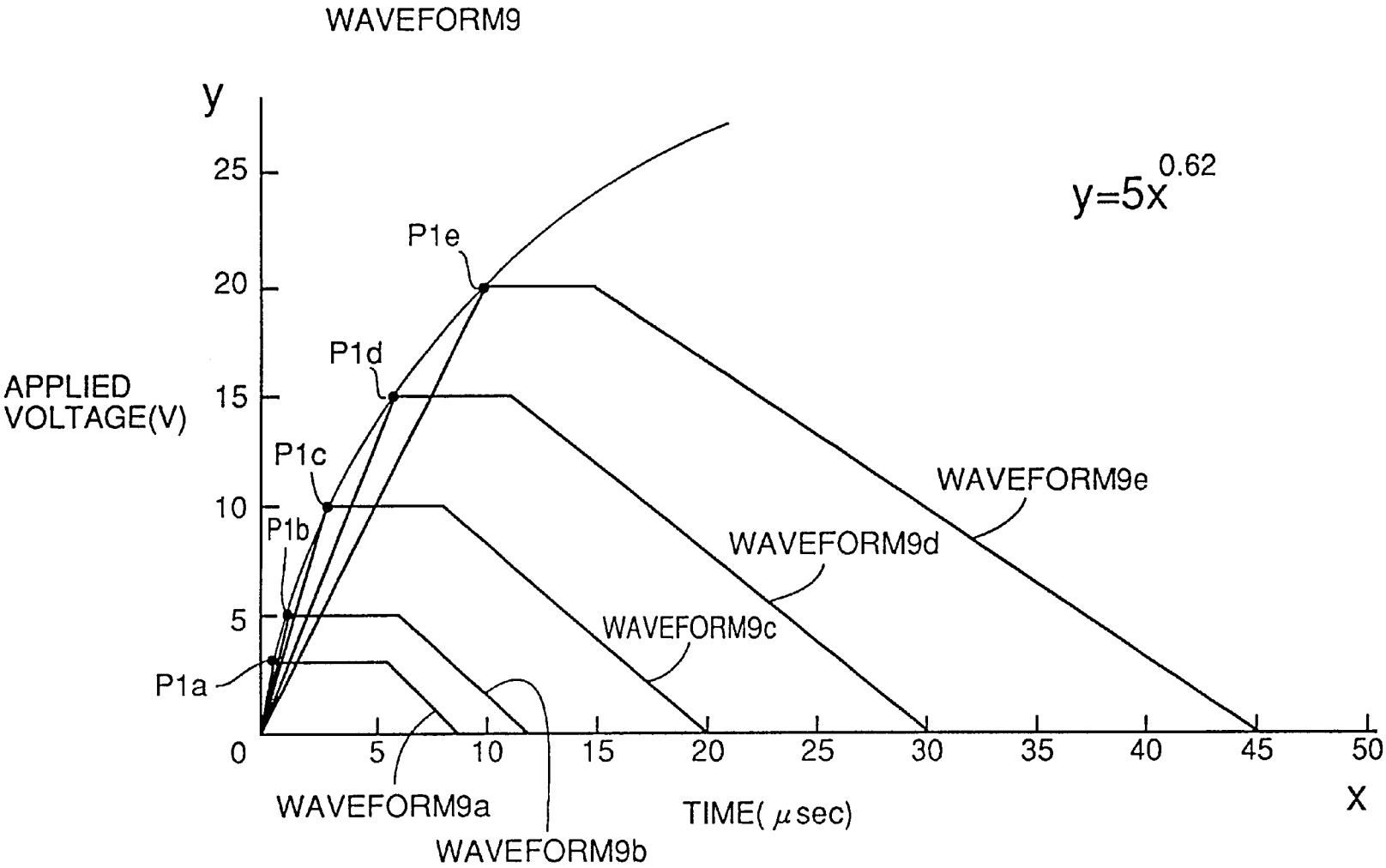

FIG. 14 is a modification of waveform 1 shown in FIG. 6. The present embodiment has two points (three points including the origin) on a curve represented by $y=5x^{0.62}$ shown in FIG. 6. Although all the points are located on the curve in the other embodiments, not all the points necessarily have to be located on the curve. In the present embodiment, at least two points including the origin are found on the curve. It is appreciated from the figure that the origin and points P1a and P1b are located on the curve. The other points are offset from the curve.

The advantage of applying a pulse voltage having the waveforms of 1–9 to a piezoelectric element will be described hereinafter.

FIG. 16 shows the evaluation of a printout by an ink droplet ejected according to a piezoelectric element to which a pulse voltage of waveforms 1–9 is applied.

Figure 15:
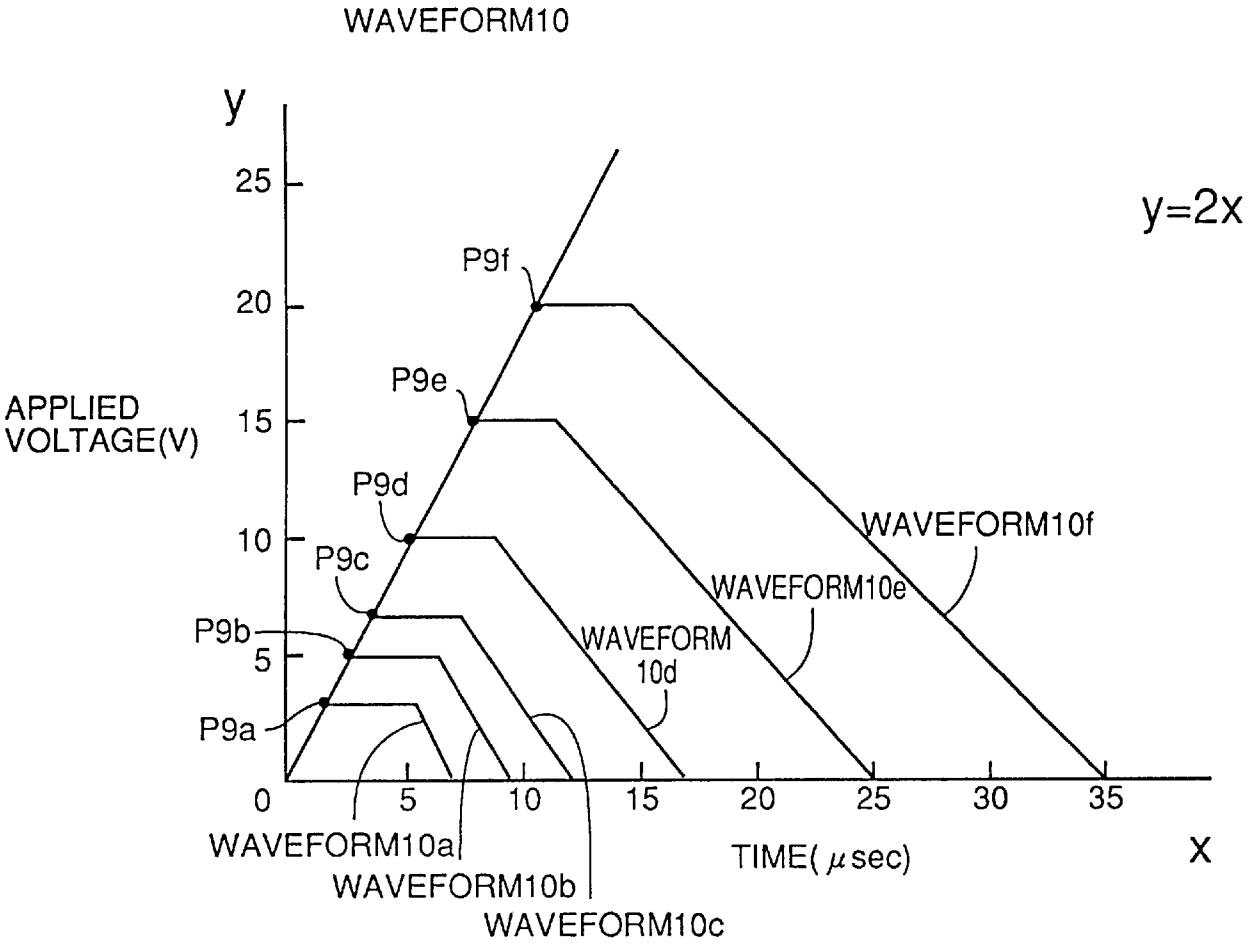
FIG. 15 PRIOR ART
FIG. 15 shows a waveform of a conventional pulse voltage which is a comparative example.

FIG. 16 includes the evaluation of a printout by a waveform 10 which is a comparative example differing from the above embodiment. Waveform 10 is a waveform set of pulse voltages applied to a piezoelectric element in a printer head of a conventional ink jet printer. This set of waveforms is shown in FIG. 15. In waveforms 10*a*–10*f*, each rising end point P9a (x=1.5, y=3) through P9f (x=10, y=20) is found on y=2x.

The printout of the droplets is effected by driving a piezoelectric element at the frequency of 3 kHz. Evaluation of the three items of satellite, dot split, and ink hit position offset for the printout of 150 dots are provided. Evaluation of satellite and dot split was effected by picking up an image with a high speed video. Evaluation of ink hit position offset was effected on the basis of a printout on a recording sheet.

In FIG. 16, the sign of ○ indicates that there was no generation for satellite and dot split, and that the position offset was within ±3% for ink hit position offset. The sign of Δ indicates that the generation was within 5% for satellite and dot split, and the position offset was ±3.5% for ink hit position offset. The sign of × indicates that the generation was 5% or more for satellite and dot split, and the position offset was at least ±5% for ink hit position offset.

The sign ○ implies that the printout is acceptable. Sign Δ implies that the printout attains an acceptable level for practical usage. Sign × implies that the printout is unacceptable for practical usage.

Evaluation on printing by waveforms 1–9 of the present embodiment and waveform 10 of a comparative example shown in FIG. 16 will be described hereinafter.

Although the satellite phenomenon is found to attain an unacceptable level for practical usage by waveform 10, this phenomenon is completely eliminated by waveforms 1–7 and 9, and is improved to a level that is acceptable in practical usage even by waveform 8. The ink hit position offset phenomenon is unacceptable for practical usage when the pulse amplitude is particularly great by waveform 10. However, this phenomenon is completely eliminated by waveforms 1–6 and 8. Also, this phenomenon has been improved to an acceptable level for practical usage by waveforms 7 and 9. The phenomenon of dot split is acceptable for practical usage even by waveform 10. However, this phenomenon is completely eliminated by waveforms 1–4 and 6–8. This phenomenon maintains an acceptable level for practical usage by waveforms 5 and 9.

Thus, the relationship of the curve $y=ax^n$ where a is a constant and n is a positive constant smaller than 1 is required. Furthermore, the printout is acceptable for practical usage when at least three points are on the predetermined curve. Not all the points have to be on the predetermined curve.

In the pulse voltage of waveforms 1–9, setting is provided so that the increasing rate of voltage with respect to time is smaller as the amplitude becomes greater at the rising edge. The sudden strain of a piezoelectric element is prevented particularly in the case of printing out an ink dot of a great diameter. By applying a pulse voltage of such a waveform to a piezoelectric element, an ink droplet of even a particularly great diameter can be sprayed out stably. The conventionally generated satellite dots, dot split noise, and ink hit position offset are prevented. The half tone can be represented without degrading the image quality.

(B) When the falling time of pulse voltage is set longer than the rise time

FIGS. 17–22 show the set of waveforms 201–206 of a pulse voltage applied to a piezoelectric element in a printer head of an ink jet printer according to eleventh to sixteenth embodiments, respectively, of the present invention. These waveforms 201–206 correspond to an ink jet printer of the eleventh to sixteenth embodiments, respectively. The entire structure of the ink jet head, the structure of the printer head, the structure of the controller and the like of the eleventh to sixteenth embodiments are similar to those of the ink jet printer of the first embodiment described in (A).

Each set of waveform is represented with the voltage plotted along the ordinate and time plotted along the abscissa, all having the voltage application start time set equal to each other. Each waveform is identified by a, b, c, d, and e assigned in order from the smallest pulse amplitude of 3, 5, 10, 15, and 20[V], respectively. A greater amplitude of a pulse provides a printout of a dot having a greater diameter. By applying a pulse voltage of different levels to the piezoelectric element, dots of different size can be printed out to represent half tone. Here, the piezoelectric element is a stacked type PZT piezoelectric element having 20 layers, each layer approximately 35[μm] in thickness, stacked and sintered. The aforementioned voltage values are applied when the piezoelectric element is assembled in the head of FIGS. 2–4. The value is not determined in a one-to-one correspondence.

Respective waveforms will be described hereinafter.

Figure 17:
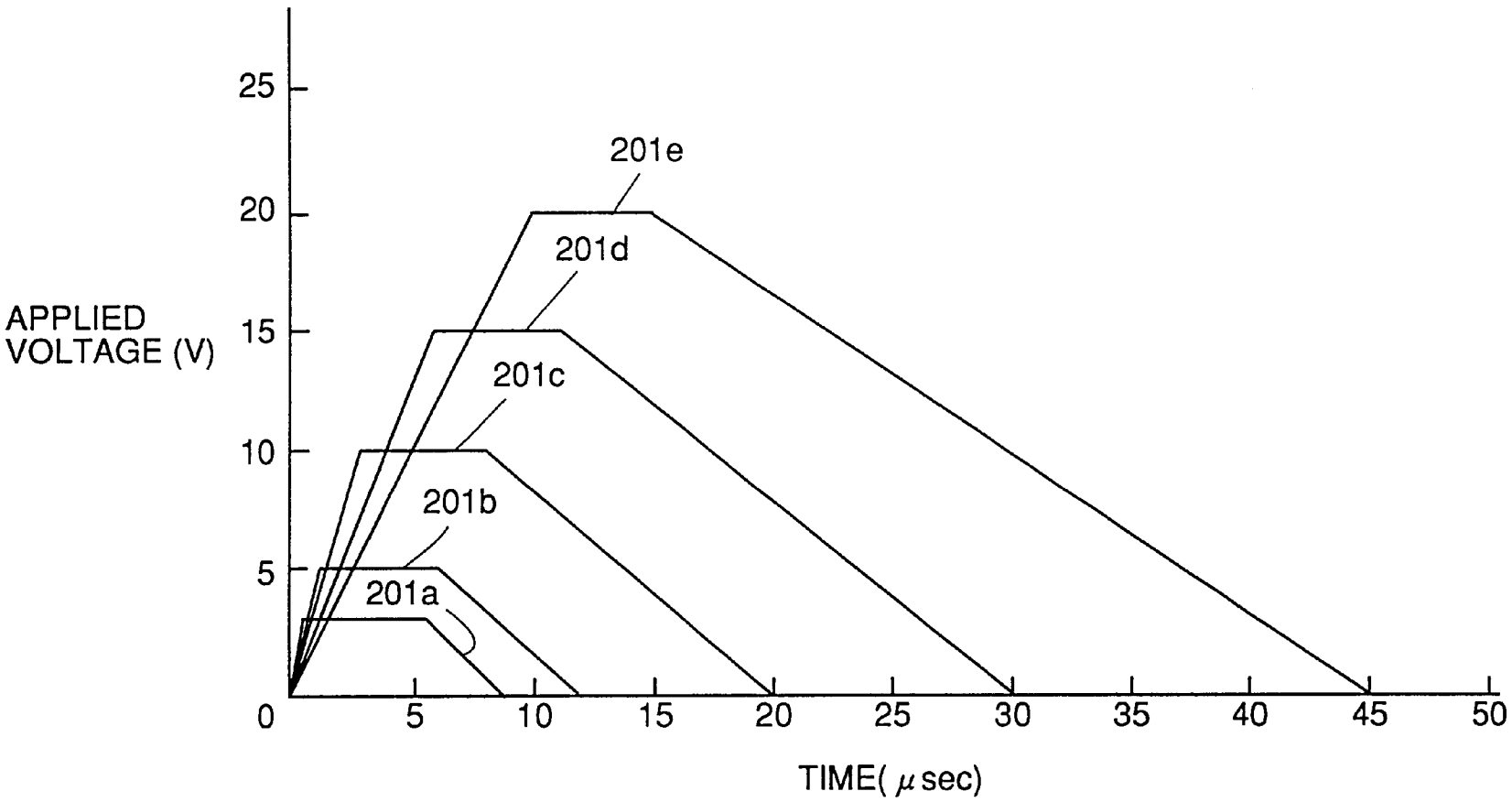
FIGS. 17–22 show waveforms of pulse voltages according to the present invention.

FIG. 17 shows waveforms 201*a*–201*e* of a pulse voltage. In these waveforms 201*a*–201*e*, the rise time is set to 0.5, 1, 3, 6, 10[μsec] and the fall time is set to 3, 6, 12, 19, 30[μsec] in order, respectively. The period of time of the duration of the pulse amplitude is set to the constant time of 5[μsec] in waveforms 201*a*–201*e*.

Figure 18:
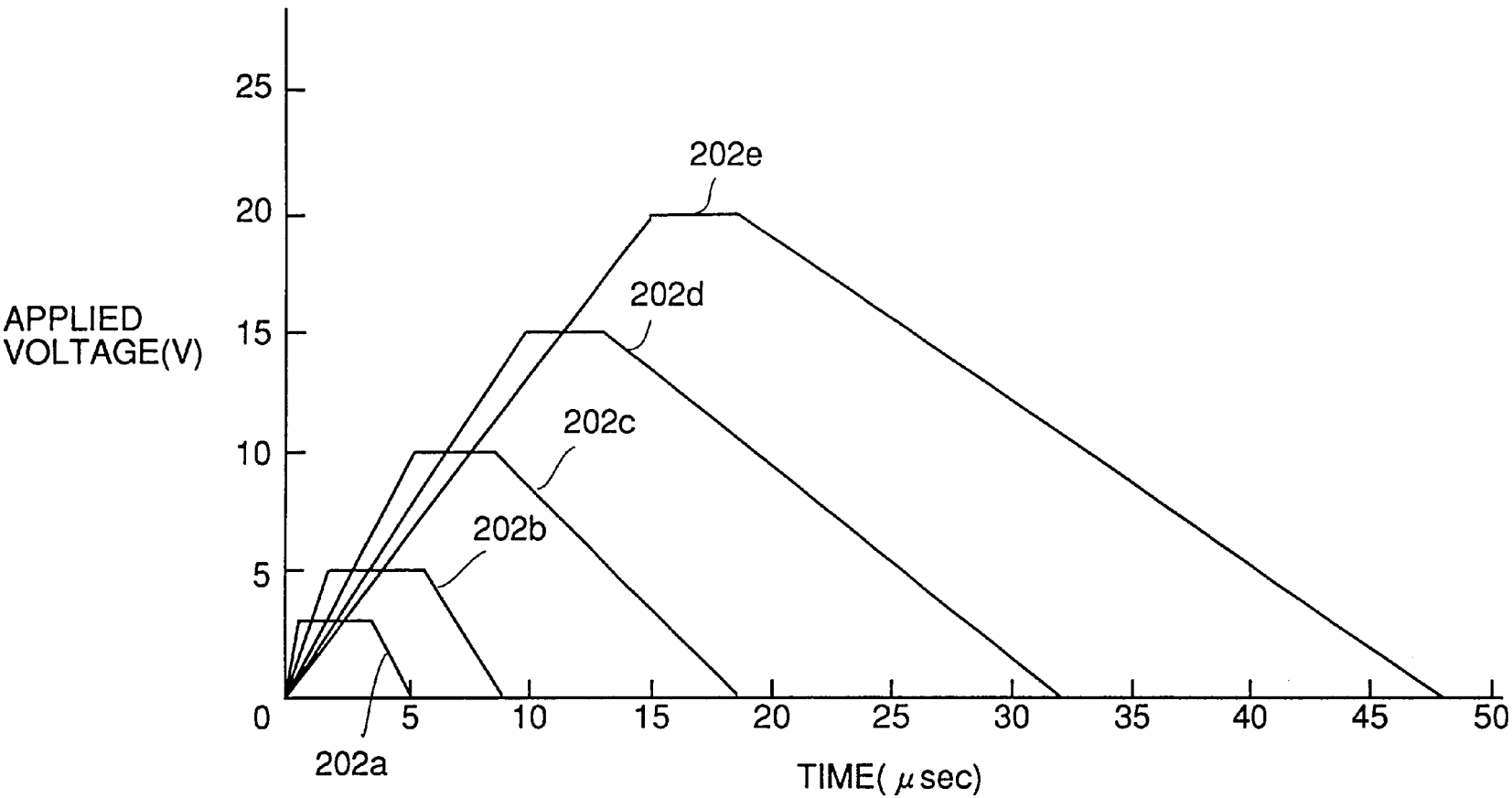

FIG. 18 shows waveforms 202*a*–202*e* of a pulse voltage. In these waveforms 202*a*–202*e*, the rise time is set to 1, 2, 5, 9.5, 15[μsec] and the fall time is set to 1.5, 4, 11, 19, 30.5[μsec] in order, respectively. The period of time of the duration of the pulse amplitude is set to the constant of 2.5[μsec] for waveforms 202*a*–202*e*.

Figure 19:
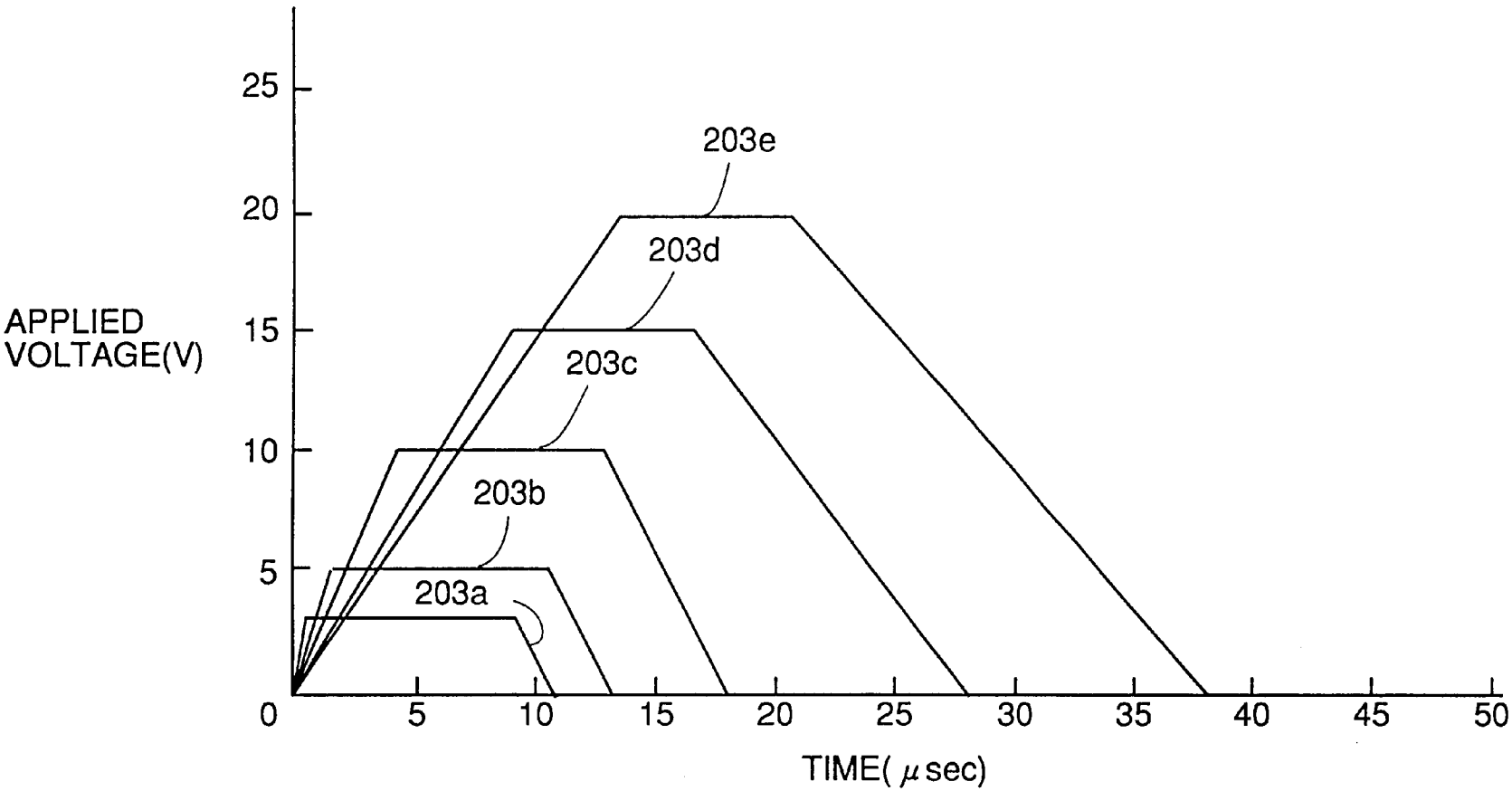

FIG. 19 shows waveforms 203*a*–203*e* of a pulse voltage. In waveforms 203*a*–203*e*, the rise time is set to 1, 1.5, 4, 8, 12[μsec] and the fall time is set to 1.5, 3, 6, 12, 18[μsec] in order, respectively. The period of time of the duration of the pulse amplitude is set to the constant of 8[μsec] for waveforms 203*a*–203*e*.

Figure 20:
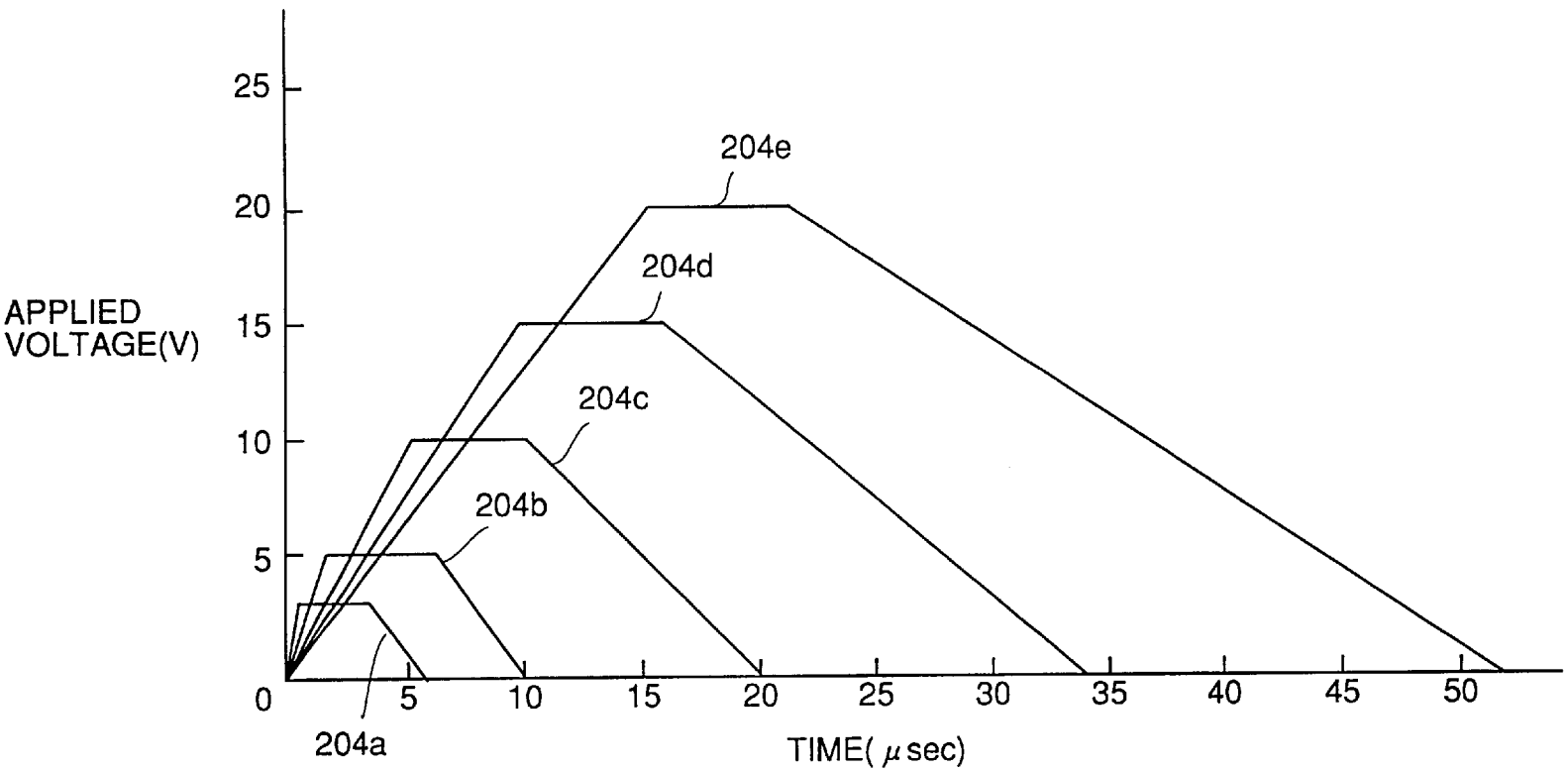

FIG. 20 shows waveforms 204*a*–204*e* of a pulse voltage. In waveforms 204*a*–204*e*, the rise time is set to 1, 2, 5, 9, 15[μsec] and the fall time is set to 1.5, 4, 10, 19, 31[μsec] in order, respectively. The duration of the pulse amplitude is set to 3, 4, 5, 6, 7[μsec] for waveforms 204*a*–204*e*, respectively.

Figure 21:
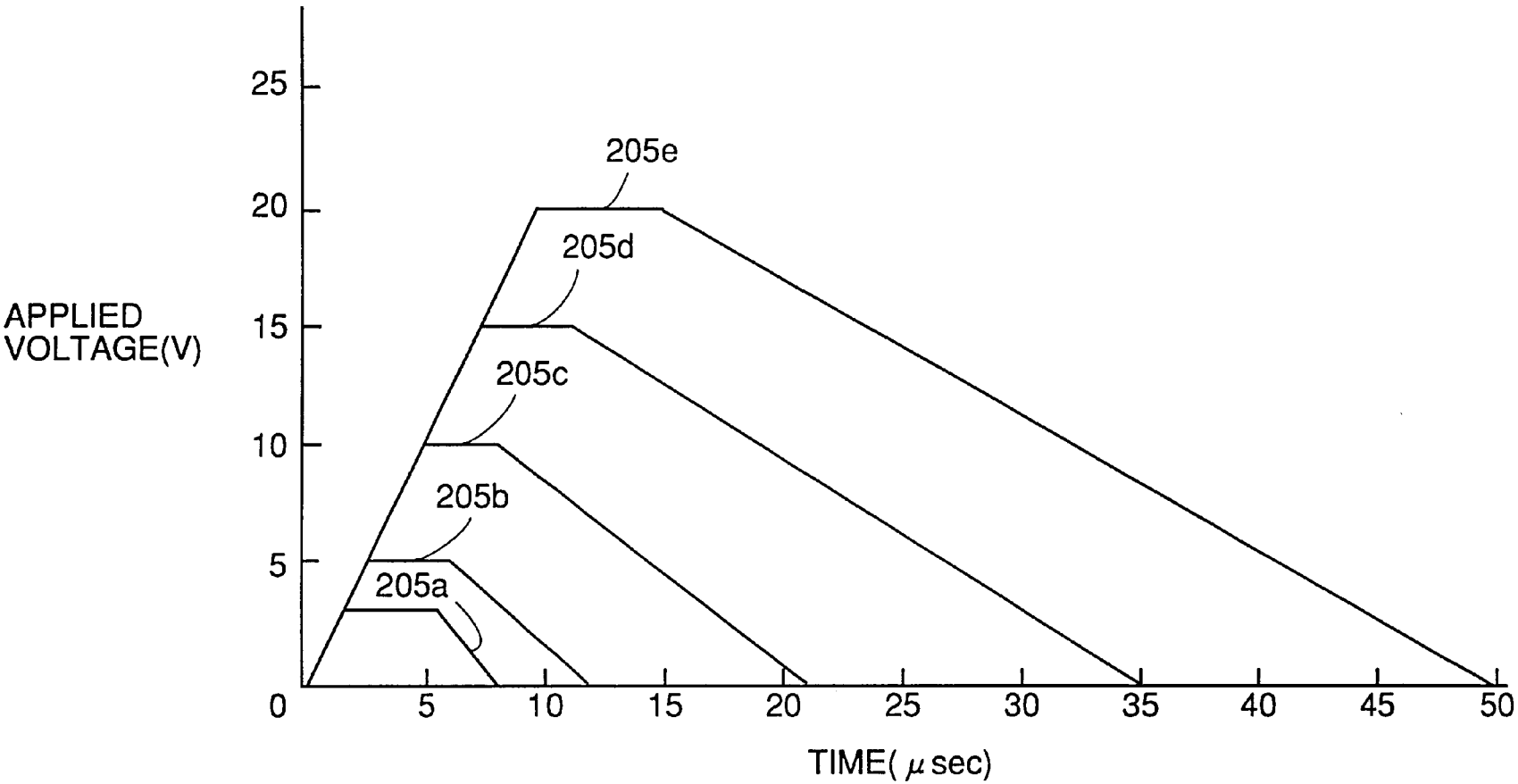

FIG. 21 shows waveforms 205*a*–205*e* of a pulse voltage. In waveforms 205*a*–205*e*, the rise time is set to 1.2, 2, 4, 6, 8[μsec] and the fall time is set to 2, 4.5, 12, 24, 37[μsec] in order, respectively. The duration of the pulse amplitude is set to the constant of 5[μsec] for waveforms 205*a*–205*e*.

Figure 22:
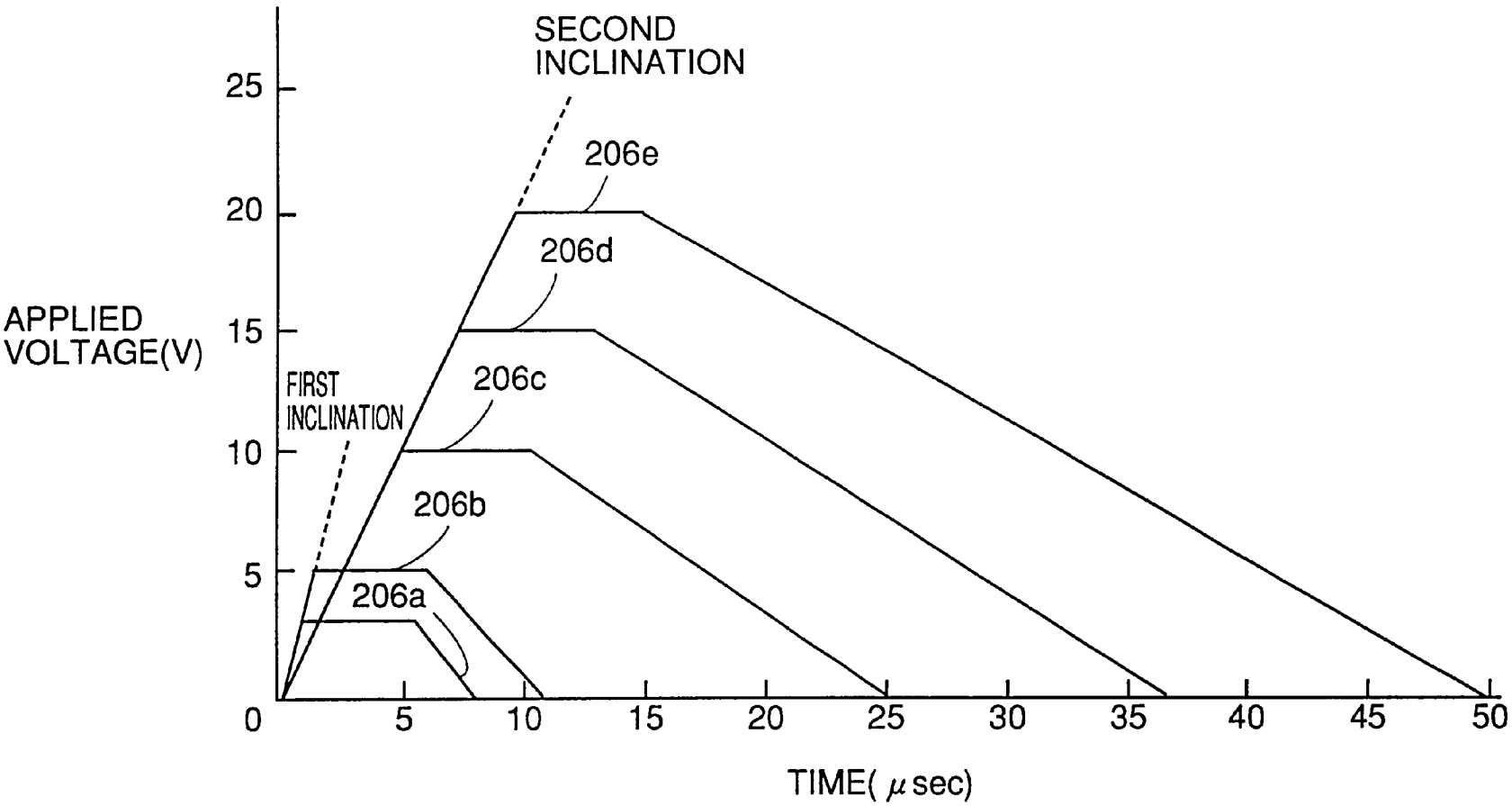

FIG. 22 shows waveforms 206*a*–206*e* of a pulse voltage. In waveforms 206*a*–206*e*, the rise time is set to 0.6, 1, 5, 7.5, 10[μsec] and the fall time is set to 2, 4.5, 15, 24.5, 35[μsec] in order, respectively. The duration of the pulse amplitude is set to the constant of 5[μsec] for waveforms 206*a*–206*e*.

In the above waveforms 201–206, the fall time is set to be longer than the rise time irrelevant to the voltage level. Next, waveforms 207 and 208 used in a conventional ink jet printer will be described hereinafter.

Figure 23:
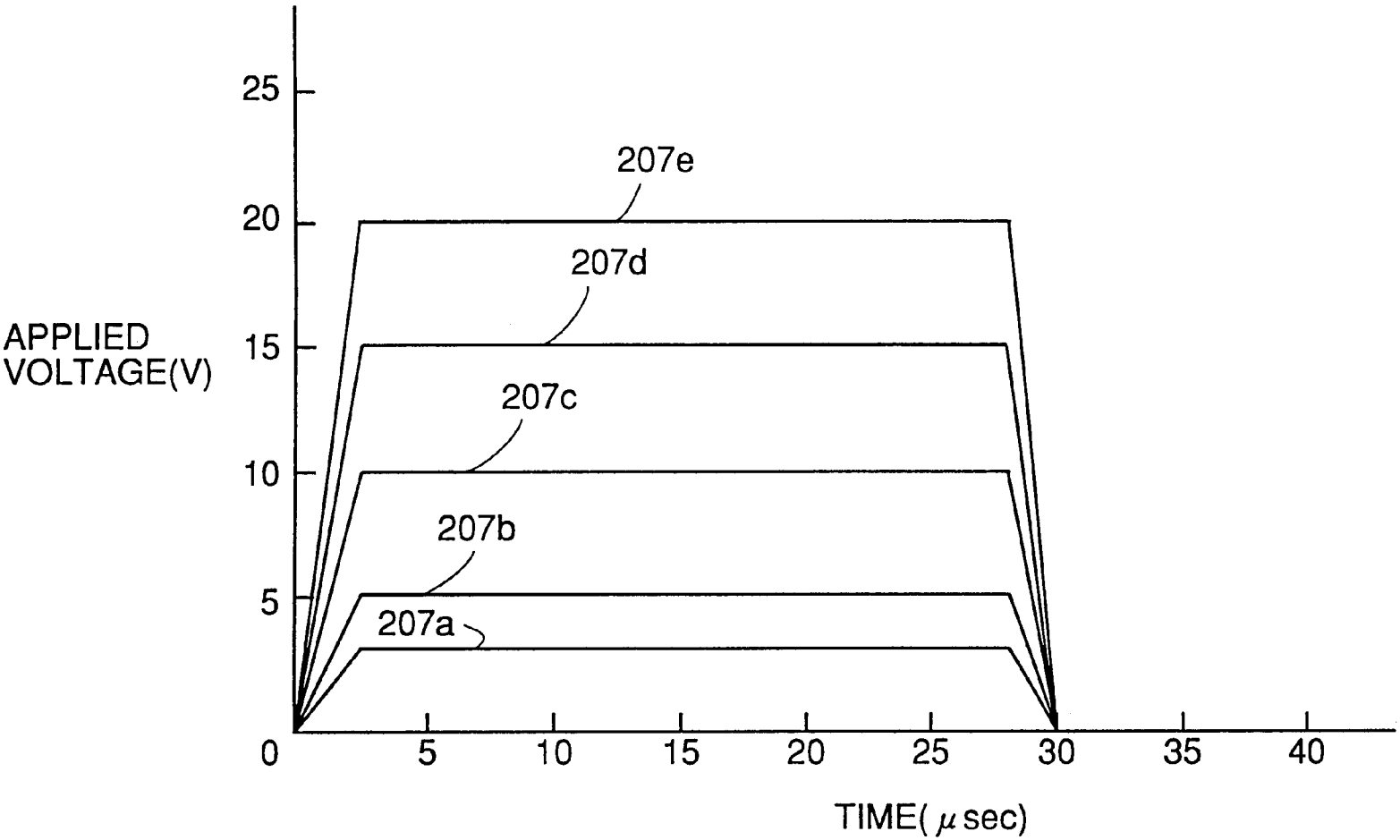
FIG.23 PRIOR ART
FIGS. 23 and 24 show waveforms of conventional pulse voltages.

FIG. 23 shows waveforms 207*a*–207*e* of a pulse voltage used in a conventional ink jet printer as a comparative example. In waveforms 207*a*–207*e*, the rise time and the fall time are both set to 2[μsec]. The duration of the pulse amplitude is set to the constant of 26[μsec] for waveforms 207*a*–207*e*.

Figure 24:
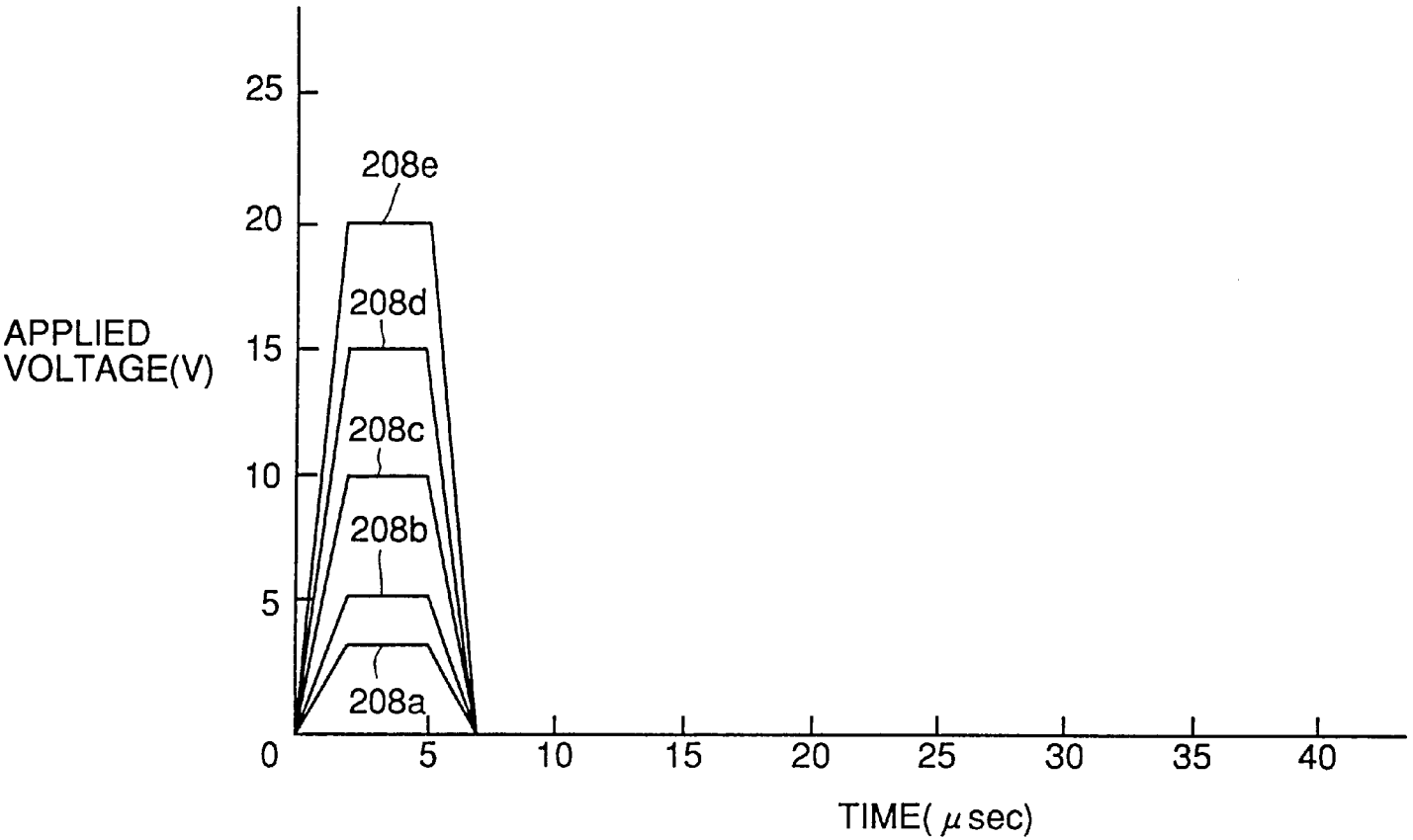
FIG.24 PRIOR ART

FIG. 24 shows waveforms 208*a*–208*e* of a pulse voltage used in a conventional ink jet printer as a comparative example. In waveforms 208*a*–208*e*, the rise time and the fall time are both set to 2[μsec]. The duration of the pulse amplitude is set to the constant of 3[μsec] for waveforms 208*a*–208*e*.

In waveforms 207 and 208, setting is provided so that the rise time and the fall time are equal to each other.

The advantage of applying a pulse voltage having waveforms 201–206 to a piezoelectric element will be described hereinafter in comparison with waveforms 207 and 208.

FIG. 25 shows the evaluation of printout by ink drops ejected from a piezoelectric element to which a pulse voltage of waveforms 201–208 is applied.

The printing was carried out by driving a piezoelectric element at the frequency of 4 kHz. The three items of satellite, dot split, ink hit position offset was provided for a printout of 200 dots. Evaluation of satellite and dot split was carried out by an image picked up with a high speed video. The ink hit position offset was evaluated with printout on a recording sheet.

In FIG. 25, the sign ○ implies that there is no generation of satellite or dot split, and the position offset for ink hit position offset was within ±3%. Sign Δ implies that the generation was within 5% for satellite and dot split, and the position offset was within ±3–5% for ink hit position offset. The sign × implies that the generation was 5% or more for satellite and dot split, and the position offset was at least ±5% for ink hit position offset.

The sign ○ implies that the printout is acceptable. The sign Δ implies that the printout is acceptable for practical usage. The sign × implies that the printout is unacceptable for practical usage.

Waveforms 201–206 according to embodiments of the present invention and waveforms 207 and 208 according to comparative examples are evaluated hereinafter.

The satellite phenomenon that is unacceptable for practical usage by waveforms 207 and 208 is completely eliminated by waveforms 201–206. The dot split phenomenon which is unacceptable by waveform 207 and acceptable for practical usage by waveform 208 is completely eliminated by waveforms 201–206. The ink hit position offset phenomenon unacceptable for practical usage by waveforms 207 and 208 is completely eliminated in waveforms 201, 202, 204 and 206, and improved to an acceptable level for practical usage by waveforms 203 and 205.

In a pulse voltage of the above waveforms 201–206, the fall time of the pulse is set longer than the rise time. This prevents generation of a wave in the ink channel. The time interval up to the next application of a pulse voltage can be made shorter, and the frequency in applying a pulse voltage can be increased. Also, the printout speed of the printer can be improved.

(II) Second Embodiment

An ink jet printer according to a second embodiment of the present invention will be described hereinafter. The entire structure of the ink jet printer of the second embodiment is basically similar to that of the first embodiment described with reference to FIGS. 1–4, provided that the control unit has a structure as shown in FIG. 26.

Figure 26:
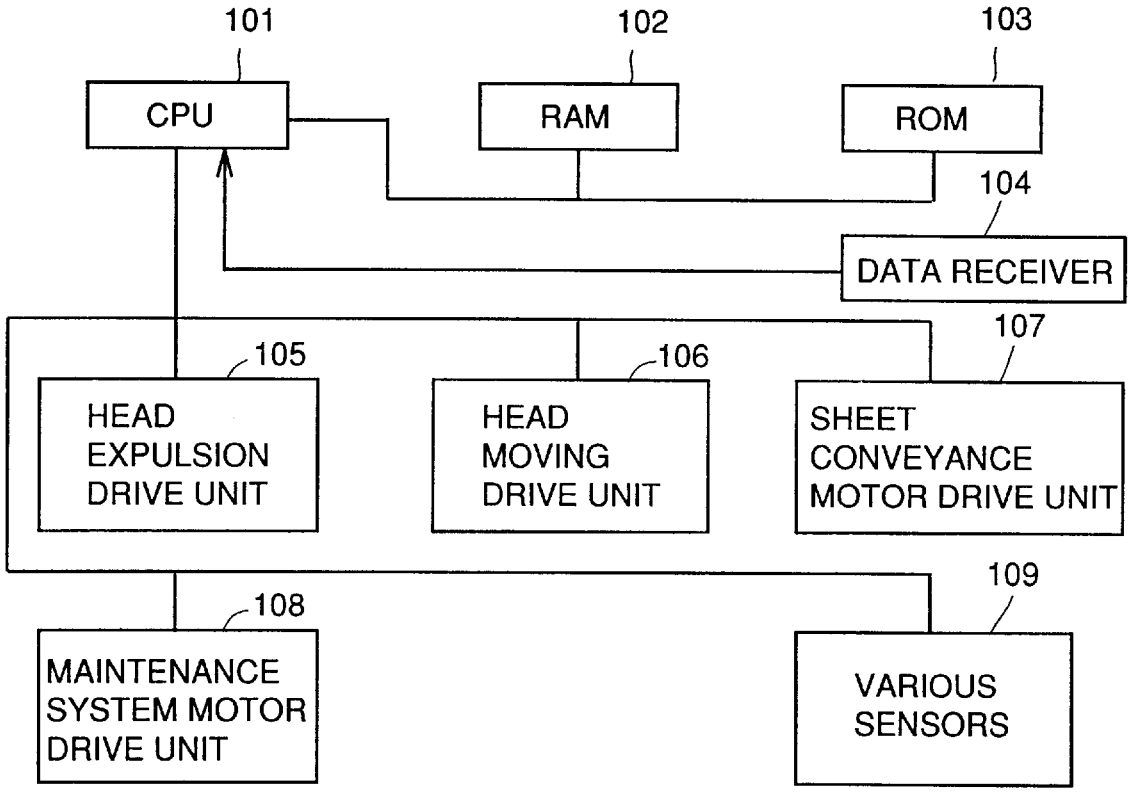
FIG. 26 is a drawing to explain the construction of the controller of an ink jet printer according to a second embodiment of the present invention.

FIG. 26 is a diagram to describe the structure of the control unit of ink jet printer 1 according to the second embodiment of the present invention.

Referring to FIG. 26, a CPU 101 that controls the entire operation executes the program saved in a ROM 103 using a RAM 102 that stores the image data when necessary. A data receiver 104 is connected to a host computer or the like and receives image data to be recorded. The program saved in ROM 103 mainly includes a part to record an image on a recording sheet 2 based on the image data read by data receiver 104 and a part to return the nozzle surface of head 3 to good condition when necessary. Where an image is to be recorded on a recording sheet 2, a head expulsion drive unit 105, a head moving drive unit 106, a sheet conveyance motor drive unit 107 and various sensors 109 are controlled by CPU 101 based on the image data read by data receiver 104. Where the nozzle surface of head 3 is to be returned to good condition, a maintenance system motor drive unit 108 and various sensors 109 are controlled by the CPU 101. In other words, based on the control by CPU 101, head expulsion drive unit 105 drives piezoelectric elements 313 of head 3 by applying a pulse voltage corresponding to the image data, head moving drive unit 106 drives drive motor 7 that moves carriage 4 supporting head 3, and paper conveyance motor drive unit 107 drives the paper conveyance roller. In addition, based on the control by CPU 101, maintenance system motor drive unit 108 drives the motor and the like needed to return the nozzle surface of head 3 to good condition.

Figure 27:
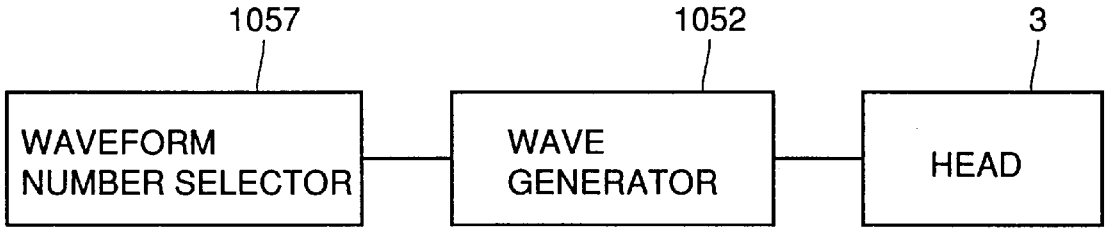
FIG. 27 is a drawing to explain the outline of the control inside the head expulsion drive unit of the second embodiment.

FIG. 27 is a drawing to explain the outline of the control of head expulsion drive unit 105.

In head expulsion drive unit 105, a waveform number identifying a pulse voltage is selected by means of a waveform number selector 1057 in response to the image data referenced in accordance with an instruction from CPU 101. A wave of a pulse voltage corresponding to the waveform number is prepared by a wave generator 1052 while the data in ROM 103 is referenced. The pulse voltage having the waveform prepared in this way is applied to piezoelectric elements 313 in head 3.

Figure 28:
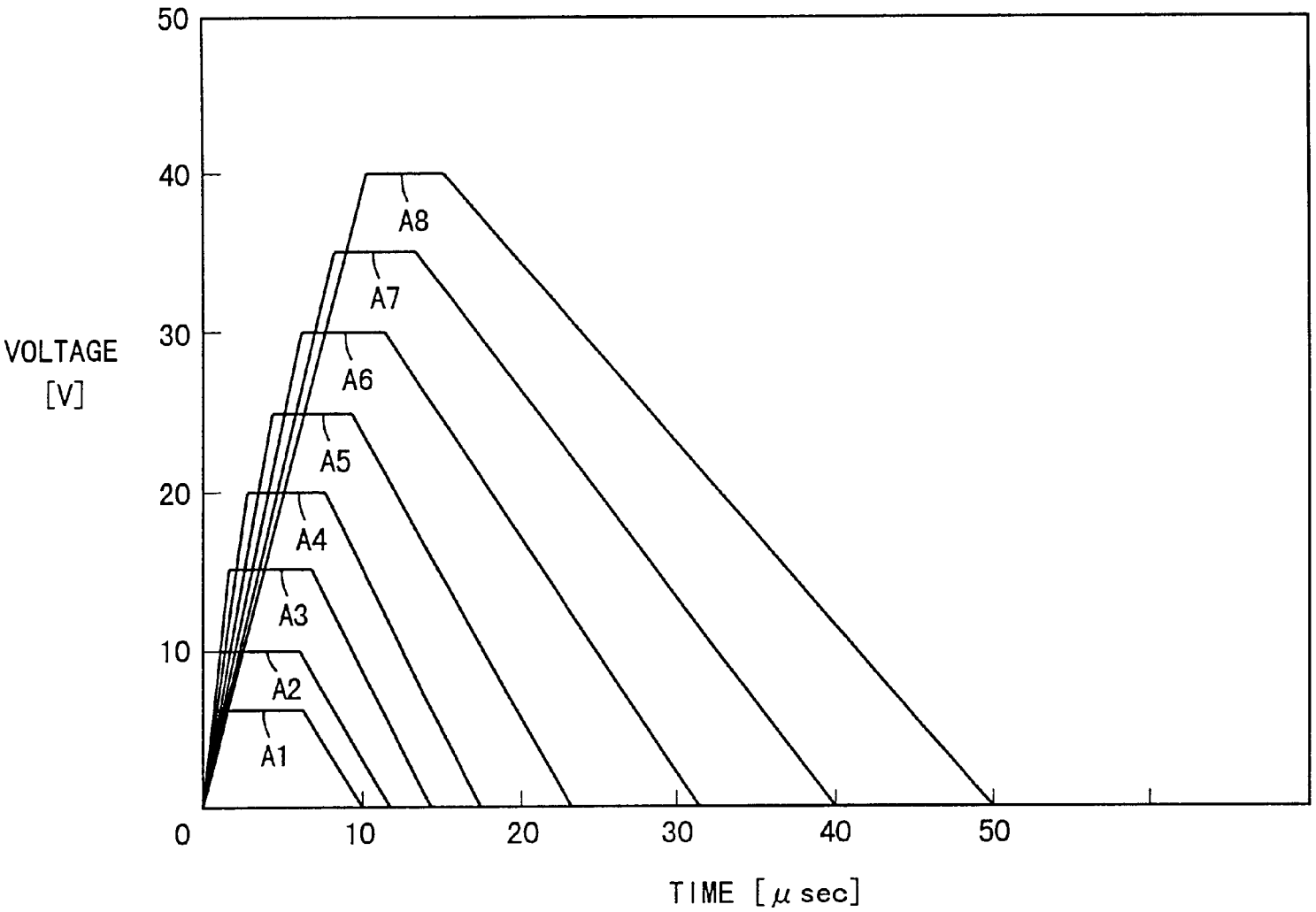
FIG. 28 is a chart showing a group of waveforms A of the pulse voltage applied to the piezoelectric elements in the ink jet printer of the second embodiment.
Figure 29:
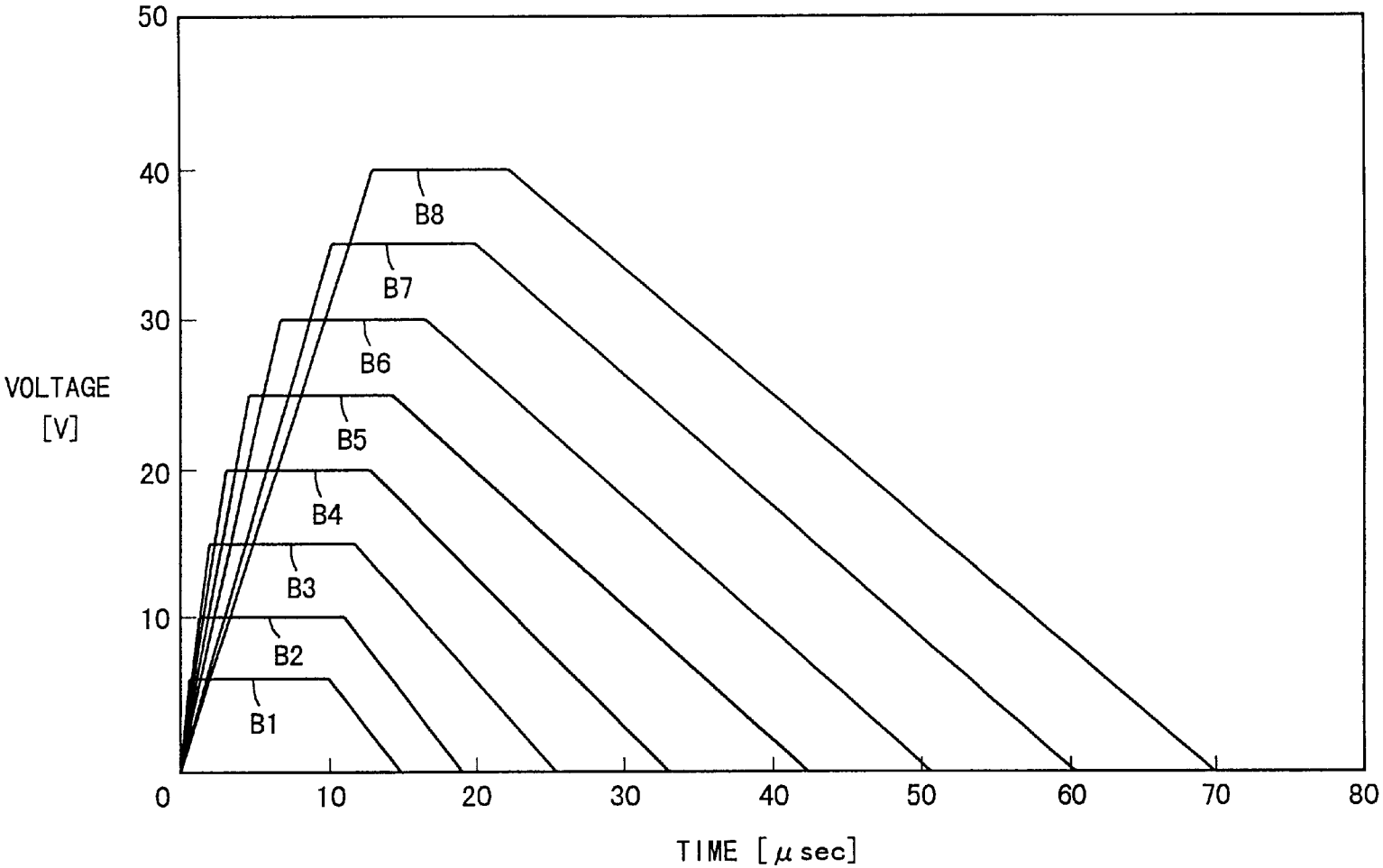
FIG. 29 is a chart showing a group of waveforms B of the pulse voltage applied to the piezoelectric elements in the ink jet printer of the second embodiment.

The relationship between the waveform of the voltage applied to a piezoelectric element 313 in ink jet printer 1 and the shape of the ink drop ejected from a nozzle 307 and adhering to a recording sheet 2 will now be explained. FIGS. 28 and 29 are charts showing the groups of waveforms A and waveforms B, respectively, for a pulse voltage applied to piezoelectric elements 313. In FIGS. 28 and 29, the pulse voltage waveforms are shown in a coordinate system displaying the voltage along the vertical axis and the time period from the onset of the voltage application along the horizontal axis. Here, all waveforms are shown as if the voltage were applied beginning at the same point in time for each, and numbers 1 through 8 are added to the alphabetical letter A or B in the increasing order of pulse amplitude.

Each waveform in FIGS. 28 and 29 has a trapezoidal configuration, and the rising speed and the falling speed are varied based on the pulse amplitude of the voltage applied to piezoelectric elements 313. Tables 1 and 2 show the pulse amplitude, the using speed (Vr) and the falling speed (Vf) of each waveform shown in FIGS. 28 and 29. The rising speed means the increase in voltage relative to the passage of time in the rising part of the pulse voltage while the falling speed means the reduction in voltage relative to the passage of time in the falling part of the pulse voltage.

TABLE 1

| Waveform | Pulse Amplitude [V] | Vr [V/μsec] | Vf [V/μsec] |
|---|---|---|---|
| A1 | 7 | 15.0 | 3.0 |
| A2 | 10 | 14.0 | 2.9 |
| A3 | 15 | 12.0 | 2.7 |
| A4 | 20 | 10.0 | 2.6 |
| A5 | 25 | 9.0 | 2.4 |
| A6 | 30 | 8.0 | 2.2 |
| A7 | 35 | 6.0 | 2.0 |
| A8 | 40 | 4.0 | 1.8 |

TABLE 2

| Waveform | Pulse Amplitude [V] | Vr [V/μsec] | Vf [V/μsec] |
|---|---|---|---|
| B1 | 7 | 13.0 | 2.5 |
| B2 | 10 | 12.0 | 2.3 |
| B3 | 15 | 11.0 | 2.0 |
| B4 | 20 | 9.0 | 1.6 |
| B5 | 25 | 7.0 | 1.4 |
| B6 | 30 | 6.0 | 1.3 |
| B7 | 35 | 4.0 | 1.0 |
| B8 | 40 | 2.5 | 0.8 |

With reference to Tables 1 and 2, the larger the pulse amplitude of the voltage applied to piezoelectric elements 313, the smaller Vr and Vf are in both waveforms A and B in the second embodiment. The rate of change of Vr and Vf relative to the change in the pulse amplitude is different between waveforms A and waveforms B. For waveforms A, Vr and Vf are smaller than Vr and Vf for the same pulse amplitude in waveforms B.

Figure 30:
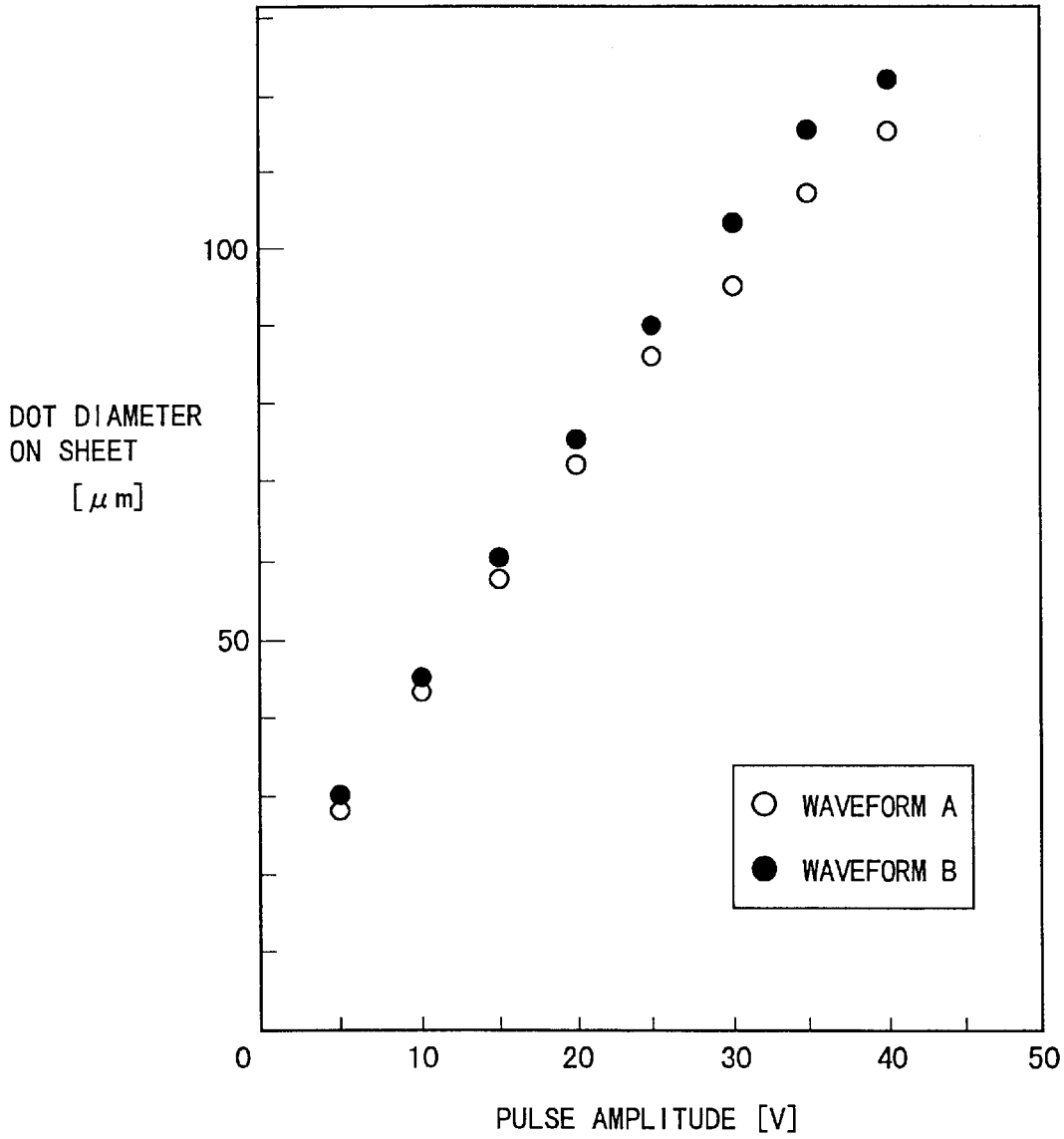
FIG. 30 is a chart showing the diameter of the ink dot expelled from a nozzle and adhering to a recording sheet in relation to the pulse amplitude, with regard to the ink jet printer of the second embodiment.

FIG. 30 shows the diameter of the dot resulting from the ink drop ejected from nozzle 307 and adhering to recording sheet 2 for the cases shown in FIGS. 28 and 29 in relation to the pulse amplitude. In FIG. 30, the data for waveforms A shown in FIG. 28 is shown by open circles, whereas the data for waveforms B shown in FIG. 29 is shown by solid circles. Each data item shown in FIG. 30 was measured under the conditions shown in Table 3.

TABLE 3

| | |
|---|---|
| Ink | DIC MAT1001 |
| Recording sheet | Epson SF paper |
| Pulse frequency | 4 kHz |

With reference to FIG. 30, in both waveforms A and waveforms B, the larger the pulse amplitude, the larger the diameter of the adhering dot becomes.

Figure 31:
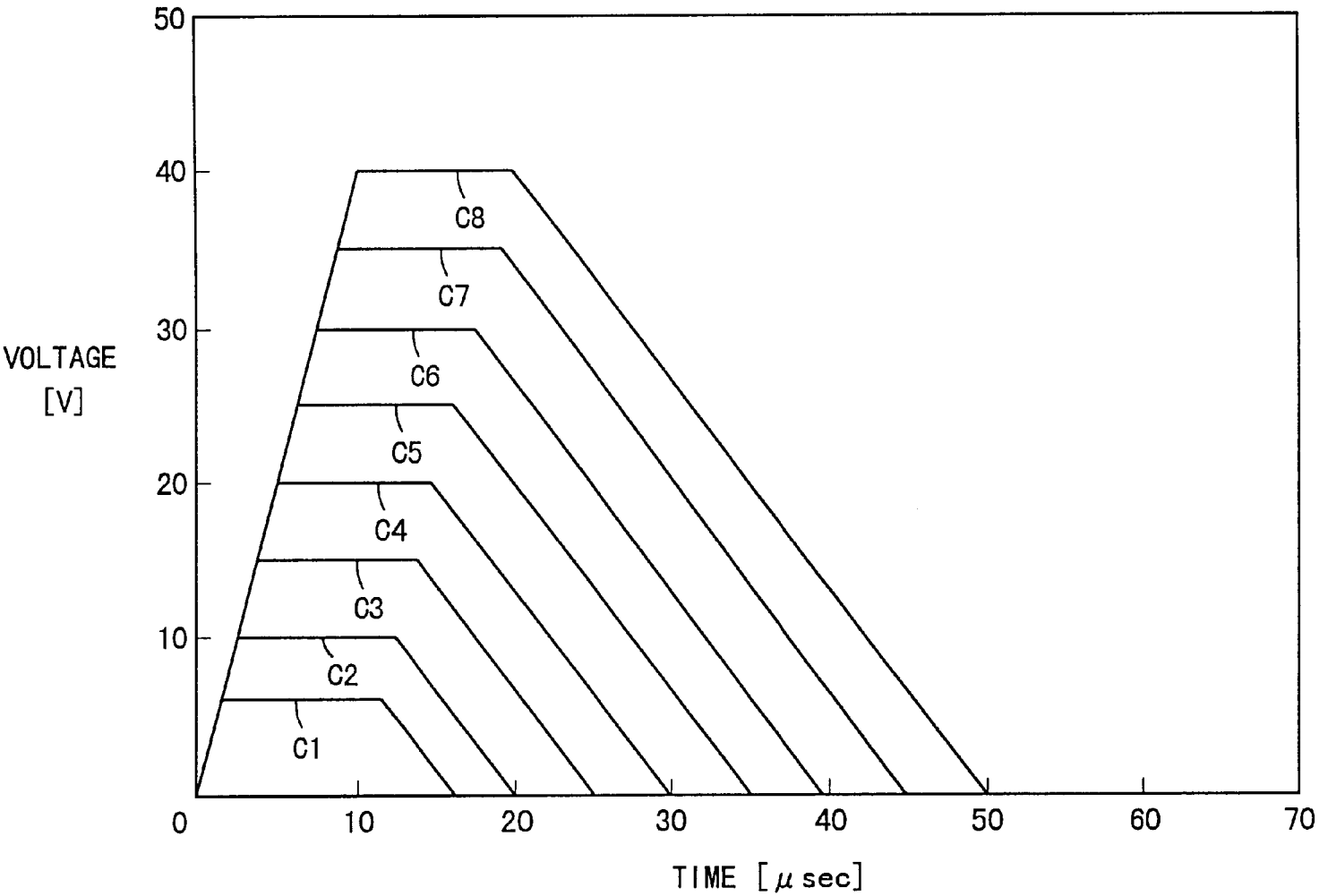
FIG. 31 is a chart showing a group of waveforms C of the pulse voltage applied to the piezoelectric elements in the ink jet printer of a comparison example.
Figure 32:
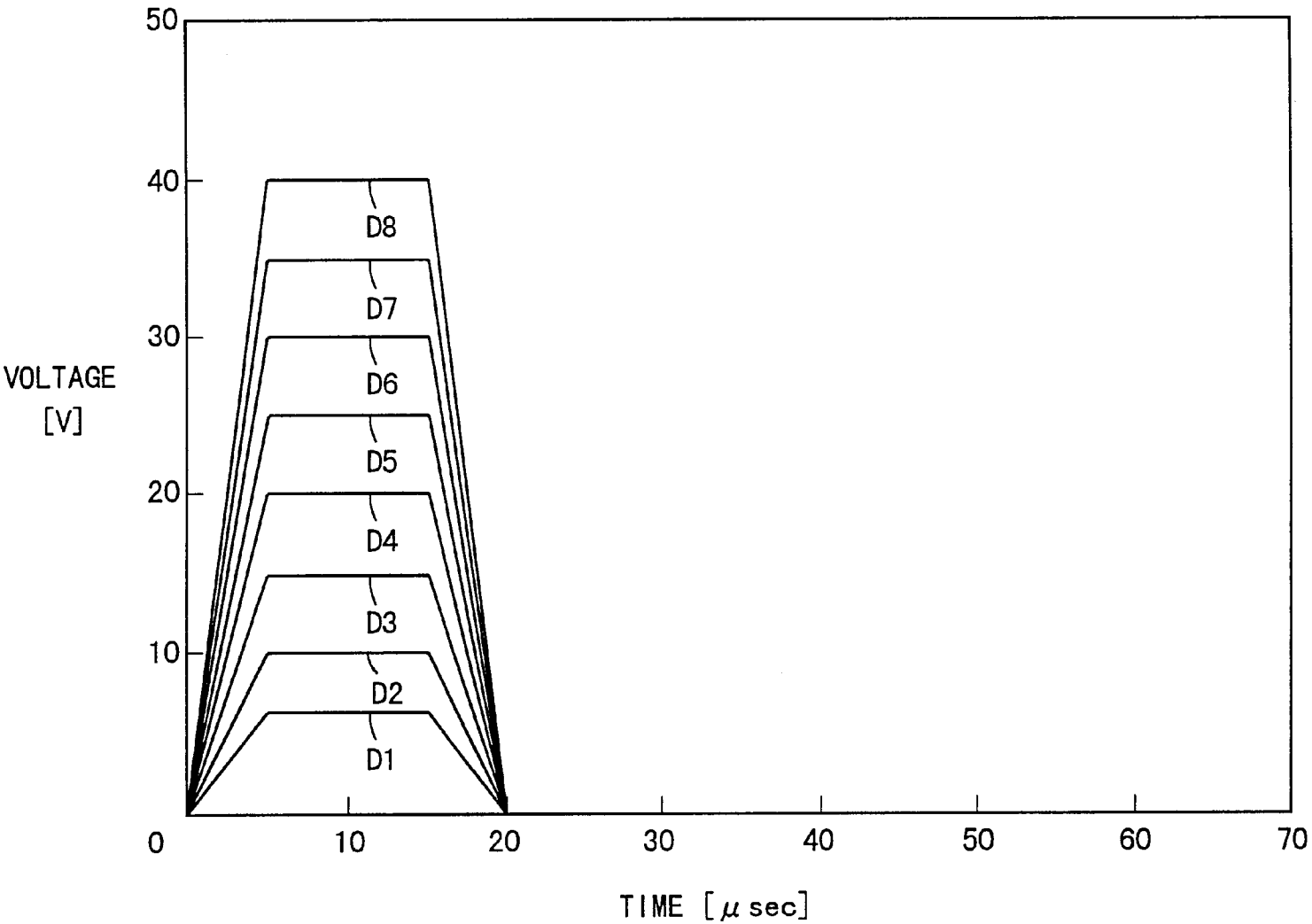
FIG. 32 is a chart showing a group of waveforms D of the pulse voltage applied to the piezoelectric elements in the ink jet printer of a comparison example.

As comparison examples for this embodiment, pulse voltages having waveforms whose characteristics were different from waveforms A or waveforms B were applied to piezoelectric elements 313. FIGS. 31 and 32 are charts showing the group of waveforms C and the group of waveforms D, respectively, for a pulse voltage applied to the piezoelectric elements for comparison purposes. In FIGS. 31 and 32 as well, the pulse voltage waveforms are shown in a coordinate system displaying the voltage along the vertical axis and the time period from the onset of the voltage application along the horizontal axis. Here, all waveforms are shown as if the voltage were applied beginning at the same point in time for each, and numbers 1 through 8 are added to the alphabetical letter C or D in the increasing order of pulse amplitude. In waveforms C shown in FIG. 31, Vr and Vf are not altered, while the pulse amplitude is altered. In waveforms D shown in FIG. 32, the using speed and the falling speed are varied depending on the pulse amplitude. Tables 4 and 5 show the pulse amplitude, Vr and Vf for each waveform shown in FIGS. 31 and 32.

TABLE 4

| Waveform | Pulse Amplitude [V] | Vr [V/μsec] | Vf [V/μsec] |
|---|---|---|---|
| C1 | 7 | 4.0 | 1.3 |
| C2 | 10 | 4.0 | 1.3 |
| C3 | 15 | 4.0 | 1.3 |
| C4 | 20 | 4.0 | 1.3 |
| C5 | 25 | 4.0 | 1.3 |
| C6 | 30 | 4.0 | 1.3 |
| C7 | 35 | 4.0 | 1.3 |
| C8 | 40 | 4.0 | 1.3 |

TABLE 5

| Waveform | Pulse Amplitude [V] | Vr [V/μsec] | Vf [V/μsec] |
|---|---|---|---|
| D1 | 7 | 1.4 | 1.4 |
| D2 | 10 | 2.0 | 2.0 |
| D3 | 15 | 3.0 | 3.0 |
| D4 | 20 | 4.0 | 4.0 |
| D5 | 25 | 5.0 | 5.0 |
| D6 | 30 | 6.0 | 6.0 |
| D7 | 35 | 7.0 | 7.0 |
| D8 | 40 | 8.0 | 8.0 |

With reference to Table 5, for waveforms D, the larger the pulse amplitude of the voltage applied to piezoelectric elements 313, the larger Vr and Vf become. In other words, for waveforms C and waveforms D, Vr and Vf do not become smaller as the pulse amplitude of the voltage applied to piezoelectric elements 313 increases, as they do in the cases of the waveforms A and the waveforms B.

Figure 33:
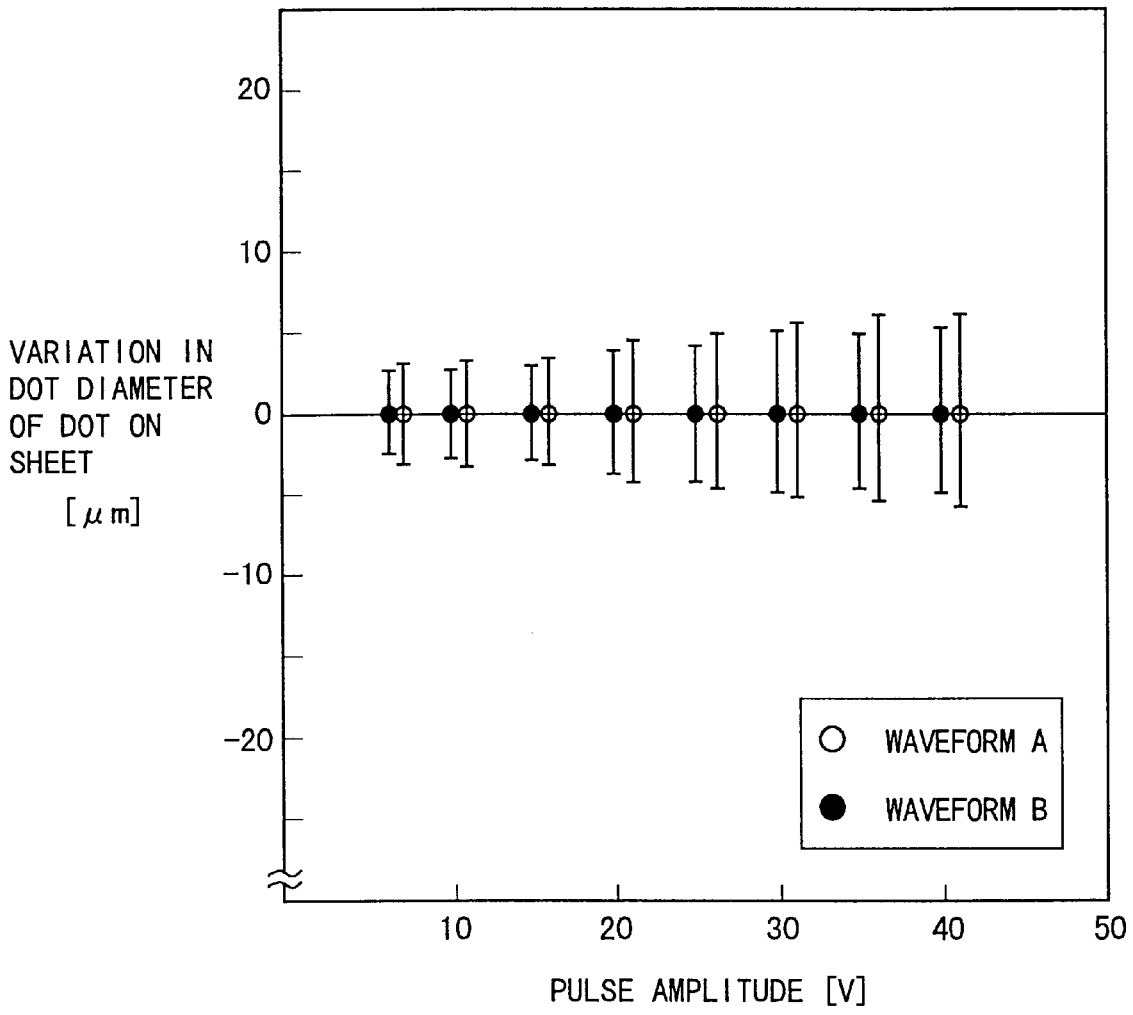
FIG. 33 is a chart showing, in relation to the pulse amplitude, the variation in the adhering dot diameter when one hundred dots were measured under the application of a waveform A pulse voltage or a waveform B pulse voltage.
Figure 34:
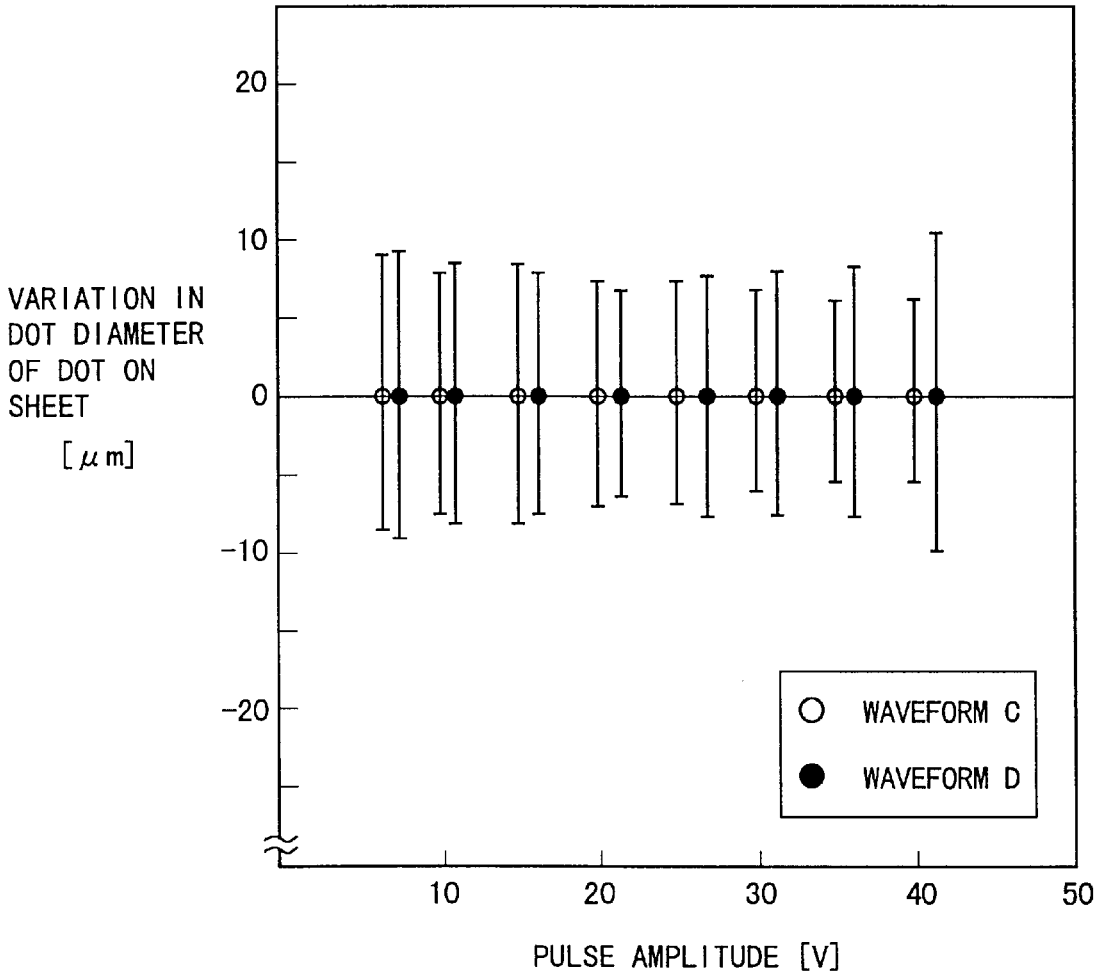
FIG. 34 is a chart showing, in relation to the pulse amplitude, the variation in the adhering dot diameter when one hundred dots were measured under the application of a waveform C pulse voltage or a waveform D pulse voltage.

In order to compare the adhering ink dots based on waveforms A and waveforms B and the adhering ink dots based on waveforms C and waveforms D, the diameter of an adhering dot based on each group of waveforms was measured a hundred times under the conditions shown in Table 3. FIG. 33 shows the variation in the diameter with regard to waveforms A and waveforms B in relation to the pulse amplitude, and FIG. 34 shows the variation in the diameter with regard to waveforms C and waveforms D in relation to the pulse amplitude. In FIG. 33, the data for waveforms A is shown by open circles whereas the data for the waveforms B is shown by solid circles. In FIG. 34, the data for waveforms C is shown by open circles while the data for waveforms D is shown by solid circles.

With reference to FIGS. 33 and 34, in the range of pulse amplitude in which the measurement was taken, the range of variation in the diameter of the dots based on waveforms A or waveforms B, which are in accordance with this embodiment, is generally smaller than that of the dots based on waveforms C or waveforms D, which are comparison examples. This is probably because when ink drops are expelled based on the waveforms A or the waveforms B in accordance with this embodiment, the speed of the moving ink drop decreases as the pulse of the voltage increases, and as a result, even where the ink drop is large, it does not disperse before adhering, such that it does not result in satellite dots or curved movement.

The adhering dots based on the waveforms A or the waveforms B have a smaller variation in their diameter than those based on the waveforms C and the waveforms D, the comparison examples, particularly in the pulse amplitude range of 20V or lower. The difference in the variation in the diameter of the adhering dot between the waveforms A or B and the waveforms C or D in the relatively small pulse amplitude range is attributable to the fact that the moving speed of the ink drop increases as the pulse amplitude of the pulse voltage decreases, i.e., the fact that an appropriate speed may be obtained for the movement of the ink drop depending on the size of the ink drop. In other words, it is possible to avoid the conventional problem that even where the ink drop is small, the moving speed is the same as or slower than that which is obtained when the ink drop is larger, resulting in an insufficient speed for the movement of the ink drop and therefore curved movement.

In other words, in the second embodiment described above, an ink dot may be made to adhere at a more accurate position on recording sheet 2 in comparison with the conventional examples over the entire dynamic range of ink jet printer 1. Therefore, an ink jet recording apparatus offering improved image quality and a larger dynamic range can be provided according to the second embodiment.

While waveforms of which the rate of change in both the rising and falling speeds decreases as the pulse amplitude increases are shown in the embodiment described above, it is also acceptable when the rate of change of either the rising speed or the falling speed decreases as the amplitude increases.

After ink 305 is ejected based on the deformation of piezoelectric elements 313, waves are caused in the ink around nozzles 307 of ink jet printer 1. Where these waves generated around nozzles 307 are not dampened before the next ejection of the ink, the volume of the ink output in the next session may vary, resulting in variation in the diameter of the adhering dot. Therefore, in order to dampen these waves rapidly, it is preferred to apply a pulse voltage for wave dampening purposes in ink jet printer 1 immediately after the application of a pulse voltage for ink expulsion and before the application of a pulse voltage for the next session of ink expulsion. The wave dampening pulse voltage preferably has a waveform that is similar to the ink expulsion pulse in order to prevent the processing performed by head expulsion drive unit 105 from becoming complex.

Figure 35:
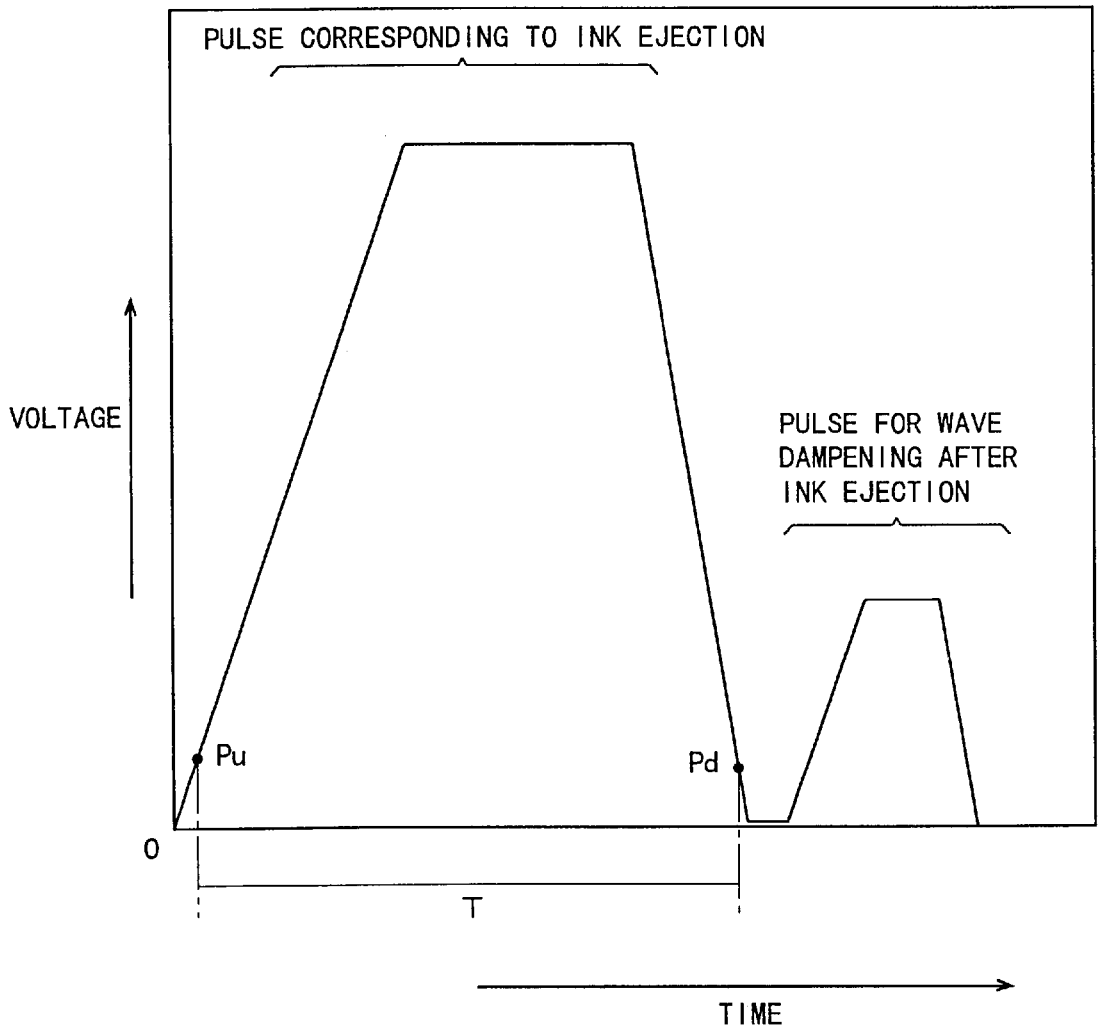
FIG. 35 is a chart showing a waveform of the pulse voltage used for the expulsion of ink and a waveform of the pulse voltage used for dampening of the ink waves, both of which are applied to the piezoelectric elements.

FIG. 35 shows one example of waveforms of the pulse voltage applied to piezoelectric elements 313 for the purpose of ink expulsion and for the purpose of dampening of the waves. If the amplitude of the wave dampening pulse were too large, excess waves would be generated, and if it were too small, the wave dampening effect could not be obtained. Therefore, it is preferred that the amplitude of the wave dampening pulse be ⅕ to ⅖ the amplitude of the ink expulsion pulse.

The application of the wave dampening pulse voltage can take place immediately after the application of the ink expulsion pulse voltage or before a certain time period elapses after said application. This period may be approximately 1.5×T if the time period between the rise and the fall of the ink expulsion pulse is T, but is preferably 1×T. Here, T is the time period that elapses from points Pu to Pd during the rise and the fall of the pulse voltage, respectively, shown in FIG. 14, which are the points at which 1/10 of the voltage of the pulse amplitude is obtained.

In other words, in this embodiment, the wave dampening pulse voltage is applied before 1.5×T, or preferably 1×T, elapses following the application of the ink expulsion pulse voltage. The timing for the application of the wave dampening pulse voltage is specified because if the application of said pulse voltage is delayed, the waves generated around nozzles 307 will spread through ink channels 306 to ink supply chamber 308, nullifying the effect of the application of the wave dampening pulse voltage.

The present invention is not limited to the above-described embodiments in which the printer head is effected in the main scanning direction. The present invention can be applied to the so-called line head type that prints out without any reciprocating motion using a head having a row of nozzles formed along a range identical to the printable range in the main scanning direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording apparatus comprising:

a piezoelectric element to which a voltage is applied for generating a strain to spray out an ink droplet, a voltage generation device for applying the voltage to a piezoelectric element according to predetermined data, wherein said voltage generation device generates a voltage of a waveform having a rising edge, a predetermined amplitude duration, and a falling edge, and a controller for controlling said voltage generation device so that an increase of voltage with respect to time at the rising edge becomes smaller as the voltage at said amplitude duration is greater.

2. An ink jet recording apparatus according to claim 1, wherein said voltage generation device applies a voltage of a plurality of different levels to said piezoelectric element to produce a plurality of ink droplets.

3. An ink jet recording apparatus according to claim 1, wherein said ink jet recording apparatus includes an ink chamber for storing ink from which said ink droplet is formed, wherein said piezoelectric element causes said ink droplet to be sprayed out by deforming said ink chamber.

4. An ink jet recording apparatus according to claim 1, wherein said ink jet recording apparatus is connected to a computer in a manner allowing communication of data, said predetermined data being sent from said computer.

5. An ink jet recording apparatus comprising:

a piezoelectric element to which a voltage is applied for generating a strain to spray out an ink droplet, a voltage generation device for applying voltage to said piezoelectric element according to predetermined data, wherein said voltage generation device generates a voltage of a waveform having a rising edge, a predetermined amplitude duration, and a falling edge, and a controller for controlling said voltage generation device so that a voltage y at the rising edge of said voltage waveform at time x of said rising edge is on a predetermined curve defined by $y=ax^n$ where a is a constant and n is a positive constant smaller than 1, or $x=a(\theta-\sin\theta)$, $y=b(1-\cos\theta)$ where a and b are constants and θ is a parameter.

6. An ink jet recording apparatus according to claim 5, wherein said rising edge includes an origin, and wherein said controller provides setting so that at least three points including the origin are located on said predetermined curve.

7. An ink jet recording apparatus according to claim 5, wherein said ink jet recording apparatus includes an ink chamber for storing ink from which said ink droplet is formed, wherein said piezoelectric element causes said ink droplet to be sprayed out by deforming the ink chamber.

8. An ink jet recording apparatus according to claim 5, wherein said ink jet recording apparatus is connected to a computer in a manner allowing communication of data, said predetermined data being sent from said computer.

9. An ink jet recording apparatus comprising:

a piezoelectric element to which a voltage is applied for generating a strain to spray out an ink droplet, a voltage generation device for applying a voltage to said piezoelectric element according to predetermined data, wherein said voltage generation device generates a voltage of a waveform having a rising edge, a maintaining portion, and a falling edge, and a controller for controlling said voltage generation device so that the time required for a fall of said waveform is longer than the time required for a rise of said waveform, wherein said controller provides control so that an inclination of the falling edge of said voltage waveform becomes more gentle as a size of said ink droplet to be sprayed out becomes greater.

10. An ink jet recording apparatus according to claim 9, wherein said controller provides control so that said maintaining portion has a predetermined voltage level between said rising edge and said falling edge.

11. An ink jet recording apparatus according to claim 9, wherein said controller provides control so that an inclination of the rising edge of said voltage waveform is altered according to a size of said ink droplet to be sprayed out.

12. An ink jet recording apparatus according to claim 11, wherein said controller provides control so that an inclination of the rising edge of said voltage waveform becomes more gentle as a size of said ink droplet to be sprayed out becomes greater.

13. An ink jet recording apparatus according to claim 9, wherein said ink jet recording apparatus includes an ink chamber for storing ink from which said ink droplet is formed, wherein said piezoelectric element causes said ink droplet to be sprayed out by deforming said ink chamber.

14. An ink jet recording apparatus according to claim 9, wherein said ink jet recording apparatus is connected to a computer in a manner allowing communication of data, said predetermined data being sent from said computer.

15. A control method for controlling an ink droplet sprayed out from an ink jet recording apparatus that applies a predetermined voltage to a piezoelectric element for generating a strain to spray out an ink droplet, said method comprising the steps of:

applying a voltage to said piezoelectric element according to predetermined data, said voltage having a voltage waveform having a rising edge, a predetermined amplitude duration, and a falling edge, and providing control so that an increase of said voltage over time at said rising edge is smaller as the voltage at said predetermined amplitude duration is greater.

16. A control method according to claim 15, wherein said voltage applying step comprises the step of applying a voltage of a plurality of different levels according to said predetermined data to said piezoelectric element, whereby ink droplets of different sizes are sprayed out.

17. A control method according to claim 15, further comprising the steps of connecting said ink jet recording apparatus to a computer in a manner allowing communication of data, and sending said predetermined data to said apparatus from said computer.

18. A control method for controlling an ink droplet sprayed out from an ink jet recording apparatus that applies a predetermined voltage to a piezoelectric element for generating a strain to spray out an ink droplet, said method comprising the steps of:

applying a voltage to said piezoelectric element according to predetermined data, said voltage having a waveform having a rising edge and a falling edge, and providing control so that a time required for falling during said falling edge is longer than the time required for rising during said rising edge, wherein an inclination of the rise of said voltage waveform during said rising edge is altered according to a size of an ink droplet that is to be sprayed out.

19. A control method according to claim 18, wherein said voltage waveform has a duration of maintaining said voltage at a predetermined level between the rising edge and the falling edge.

20. A control method according to claim 18, wherein an inclination of a rise of said voltage waveform during said rising edge is set to become more gentle as a size of an ink droplet to be sprayed out becomes greater.

21. A control method according to claim 18, wherein an inclination of a fall of said voltage waveform during said falling edge is set to become more gentle as a size of an ink droplet to be sprayed out becomes greater.

22. A control method according to claim 18, further comprising the steps of connecting said ink jet recording apparatus to a computer in a manner allowing communication of data, and sending said predetermined data to said apparatus from said computer.

23. A control apparatus of an ink jet recording apparatus that applies a predetermined voltage to a piezoelectric element for generating a strain to spray out an ink droplet, comprising:

means for applying a voltage to said piezoelectric element according to predetermined data, said voltage having a voltage waveform having a rising edge, a predetermined amplitude duration, and a falling edge, and a controller to control so that increase of said voltage over time at said rising edge is smaller as the voltage at said predetermined amplitude duration is greater.

24. A control apparatus of an ink jet recording apparatus that applies a predetermined voltage to a piezoelectric element for generating a strain to spray out an ink droplet, comprising:

means for applying a voltage to said piezoelectric element according to predetermined data, said voltage having a waveform having a rising edge, an amplitude duration, and a falling edge, and a controller to control the means for applying a voltage so that the decrease of voltage with respect to time during the falling edge becomes smaller as the voltage at the amplitude duration is greater.

25. An ink jet recording apparatus comprising:

an electromechanical conversion element discharging ink in an ink chamber from a nozzle, a pulse apply unit applying a pulse signal to said electromechanical conversion element, and a control unit controlling said pulse apply unit so that at least one of a rising speed and a falling speed of said pulse decreases as an amplitude of said pulse signal becomes greater.

26. An ink jet recording apparatus according to claim 25, wherein said control unit controls said pulse apply unit to apply a second pulse to reduce a wave in said ink channel after said pulse.

27. An ink jet recording apparatus according to claim 26, wherein said second pulse has a waveform analogous to the waveform of a pulse for ejecting ink.

28. An ink jet recording apparatus according to claim 26, wherein said second pulse has an amplitude smaller than the amplitude of said pulse signal.

29. A control method of an ink jet recording apparatus, comprising the steps of:

generating a pulse waveform including an amplitude corresponding to an image signal according to an input image signal, and a portion where at least one of a rising speed and falling speed of a pulse becomes lower as the amplitude is greater, and applying a pulse of said generated pulse waveform to an electromechanical conversion element.

30. A control method according to claim 29, wherein said electromechanical conversion element ejects ink into an ink channel from a nozzle, and further including the step of:

applying a second pulse after said pulse to reduce a wave in said ink channel.

31. A control method according to claim 30, wherein said second pulse has a waveform analogous to the pulse waveform.

32. A control method according to claim 30, wherein said second pulse has an amplitude smaller than the amplitude of said pulse waveform.

33. A control device of an ink jet recording apparatus comprising:

a pulse waveform generation unit generating a pulse having an amplitude portion corresponding to an image signal according to an input image signal and a portion where at least one of a rising speed and falling speed of said pulse becomes lower as the amplitude becomes greater, and a pulse apply unit applying said pulse to an electromechanical conversion element.

34. A control device according to claim 33, wherein said electromechanical conversion element ejects ink in an ink channel from a nozzle, wherein said pulse apply unit applies a second pulse after said pulse to reduce a wave in said ink channel.

35. A control device according to claim 34, wherein said second pulse has a waveform analogous to the pulse.

36. A control device according to claim 34, wherein said second pulse has an amplitude smaller than the amplitude of the pulse.

37. An ink jet recording apparatus comprising:

an electromechanical conversion element for ejecting an ink dot of a different size from ink in an ink channel through a nozzle, a pulse apply unit applying a pulse signal to said electromechanical conversion element, and a control unit controlling said pulse apply unit so that at least one of a rising speed and a falling speed of said pulse signal decreases as the size of said ejecting ink dot becomes larger.

38. An ink jet recording apparatus according to claim 37, wherein said control unit applies a second pulse after said pulse signal to reduce a wave in said ink channel.

39. An ink jet recording apparatus according to claim 38, wherein said second pulse has a waveform analogous to the waveform of a pulse signal, and said second pulse has an amplitude smaller than the amplitude of a pulse signal.

40. An ink jet recording apparatus comprising:

a piezoelectric element to which a voltage is applied for generating a strain to spray out an ink droplet, a voltage generation device for applying a voltage to said piezoelectric element according to predetermined data, wherein said voltage generation device generates a voltage of a waveform having a rising edge, an amplitude duration, and a falling edge, and a controller for controlling said voltage generation device so that the decrease of voltage with respect to time during the falling edge becomes smaller as the voltage at the amplitude duration is greater.

41. A control method for controlling an ink droplet sprayed out from an ink jet recording apparatus that applies a predetermined voltage to a piezoelectric element for generating a strain to spray out an ink droplet, said method comprising the steps of:

applying a voltage to said piezoelectric element according to predetermined data, said voltage having a waveform having a rising edge, an amplitude duration, and a falling edge, and providing control so that a time required for falling during said falling edge is longer than the time required for rising during said rising edge, and so that the decrease of voltage with respect to time during the falling edge becomes smaller as the voltage at the amplitude duration is greater.

* * * * *